US012172819B2

(12) United States Patent
Okada et al.

(10) Patent No.: US 12,172,819 B2
(45) Date of Patent: Dec. 24, 2024

(54) PACKAGING BAG AND PACKAGING BODY

(71) Applicants: TOPPAN INC., Tokyo (JP); HISAMITSU PHARMACEUTICAL CO., INC., Tosu (JP)

(72) Inventors: Kazuyoshi Okada, Tokyo (JP); Yoshikazu Kuwano, Tokyo (JP); Hiroshi Oishi, Tosu (JP); Tetsuhiro Kawano, Tosu (JP)

(73) Assignees: TOPPAN INC., Tokyo (JP); HISAMITSU PHARMACEUTICAL CO., INC., Tosu (JP)

( * ) Notice: Subject to any disclaimer, the term of this patent is extended or adjusted under 35 U.S.C. 154(b) by 0 days.

(21) Appl. No.: 18/040,188

(22) PCT Filed: Jul. 30, 2021

(86) PCT No.: PCT/JP2021/028433
§ 371 (c)(1),
(2) Date: Feb. 1, 2023

(87) PCT Pub. No.: WO2022/030401
PCT Pub. Date: Feb. 10, 2022

(65) Prior Publication Data

US 2023/0286724 A1 Sep. 14, 2023

(30) Foreign Application Priority Data

Aug. 4, 2020 (JP) ..... 2020-132630

(51) Int. Cl.
*B65D 77/38* (2006.01)
*B65D 65/40* (2006.01)
*B65D 77/12* (2006.01)

(52) U.S. Cl.
CPC ..... *B65D 77/38* (2013.01); *B65D 65/40* (2013.01); *B65D 77/12* (2013.01)

(58) Field of Classification Search
CPC ..... B65D 77/12; B65D 77/38; B65D 65/40
(Continued)

(56) References Cited

FOREIGN PATENT DOCUMENTS

JP 1102949 S 3/2001
JP 1102950 S 3/2001
(Continued)

OTHER PUBLICATIONS

Written Opinion (Form PCT/ISA/237); mailed Sep. 28, 2021 in corresponding PCT Application No. PCT/JP2021/028433 (5 pages) (5 pages English Translation).
(Continued)

*Primary Examiner* — Peter N Helvey
(74) *Attorney, Agent, or Firm* — STAAS & HALSEY LLP

(57) ABSTRACT

A packaging bag includes a cutting guide band extending along a transverse direction. The cutting guide band includes, a first guide band having first cut lines that are inclined at a predetermined angle with respect to the transverse direction; a second guide band having second cut lines that are inclined at a predetermined angle in a direction opposite a direction of the first cut lines with respect to the transverse direction; and a third guide band having third cut lines that are inclined at a predetermined angle in the same direction as the direction of the first cut lines with respect to the transverse direction. The cutting guide band has a fourth cut line between the first guide band and the second guide band and/or between the second guide band and the third guide band, the fourth cut line being perforated and extending along the transverse direction.

10 Claims, 14 Drawing Sheets

(58) Field of Classification Search
USPC ..... 383/207
See application file for complete search history.

(56) References Cited

FOREIGN PATENT DOCUMENTS

| | | | | |
|---|---|---|---|---|
| JP | 4648605 | | * | 12/2010 |
| JP | 4648605 | B2 | | 12/2010 |
| JP | 5998425 | | * | 9/2016 |
| JP | 5998425 | B2 | | 9/2016 |
| JP | 2019-156491 | | * | 9/2019 |
| JP | 2019-156491 | A | | 9/2019 |
| WO | WO 01/62616 | A1 | | 8/2001 |

OTHER PUBLICATIONS

Notification of Transmittal of Preliminary Report on Patentability (Form PCT/IB/338); mailed Feb. 16, 2023 in corresponding PCT Application No. PCT/JP2021/028433 (1 page).
International Preliminary Report on Patentability (Form PCT/IB/373); mailed Feb. 7, 2023 in corresponding PCT Application No. PCT/JP2021/028433 (1 page).
International Search Report (Form PCT/ISA/210); mailed Sep. 28, 2021 in corresponding PCT Application No. PCT/JP2021/028433 (3 pages) (2 pages English Translation).
Written Opinion (Form PCT/ISA/237); mailed Sep. 28, 2021 in corresponding PCT Application No. PCT/JP2021/028433 (5 pages).

* cited by examiner

PACKAGING BAG AND PACKAGING BODY

CROSS REFERENCE TO RELATED APPLICATIONS

This application is a U.S. national stage of International Application No. PCT/JP2021/028433, filed on Jul. 30, 2021, which claims the priority benefit of Japanese Application No. 2020-132630, filed on Aug. 4, 2020. The International Application and the Japanese Application are incorporated by reference herein in their entirety.

TECHNICAL FIELD

The present disclosure relates to a packaging bag and a packaging body.

BACKGROUND ART

A packaging bag that seals and stores a packaging article such as a medicine and foodstuffs is known. Such a packaging bag is formed by pasting together peripheral edge portions of a pair of laminated films in each of which a plurality of films made of different materials are laminated. A mode for facilitating unsealing of such a packaging bag by providing perforated cut lines on a front surface and a back surface of the packaging bag is implemented.

Patent Literature 1 has proposed that a plurality of perforated cuts formed on a first surface and a plurality of perforated cuts formed on a second surface are formed to be inclined in opposite directions with respect to a predetermined unsealing direction. A technique has been proposed in which all the perforated cuts on the front surface and on the back surface are inclined in such a manner, and the inclinations of the perforated cuts are set to be reversed between the front surface and the back surface, so that a grip portion is formed at an unsealed opening after unsealing and is easily gripped with the fingertips after unsealing. Patent Literature 2 has proposed a technique for facilitating unsealing by providing a guide cut band between guide cut rows extending in a lateral direction, and by setting minor angles of a plurality of cut lines in the guide cut band to different angles.

CITATION LIST

Patent Literature

Patent Literature 1: Japanese Patent No. 4648605
Patent Literature 2: Japanese Unexamined Patent Publication No. 2019-156491

SUMMARY OF INVENTION

Technical Problem

As in Patent Literatures 1 and 2, since the plurality of inclined cut lines are provided, the packaging bag can be smoothly unsealed, and a packaging article can be easily taken out. The present disclosure provides a packaging bag capable of sufficiently preventing cut-opening from deviating from a cutting guide band and progressing in an unexpected direction during unsealing, while further enhancing these advantages. In addition, a packaging body including such a packaging bag is provided.

Solution to Problem

The present disclosure provides a packaging bag including: a first laminated film portion on a front surface side; a second laminated film portion on a back surface side, that is pasted to the first laminated film portion; and a cutting guide band extending in a band shape along a transverse direction from one side end portion toward the other side end portion on each of a front surface and a back surface. The cutting guide band provided in the packaging bag includes, in order from an upper end portion side, a first guide band having a plurality of first cut lines that are inclined at a predetermined angle with respect to the transverse direction, and that are arranged parallel to each other; a second guide band having a plurality of second cut lines that are perforated, that are inclined at a predetermined angle in a direction opposite a direction of the first cut lines with respect to the transverse direction, and that are arranged parallel to each other at predetermined intervals; and a third guide band having a plurality of third cut lines that are inclined at a predetermined angle in the same direction as the direction of the first cut lines with respect to the transverse direction, and that are arranged parallel to each other.

In the packaging bag, the cutting guide band has a fourth cut line between the first guide band and the second guide band and/or between the second guide band and the third guide band, the fourth cut line being perforated and extending along the transverse direction. The first cut lines, the second cut lines, the third cut lines, and the fourth cut line are spaced apart from each other. The first cut lines, the second cut lines, and the third cut lines on the front surface are inclined in directions opposite directions of the first cut lines, the second cut lines, and the third cut lines on the back surface with respect to the transverse direction, respectively.

The packaging bag includes the first guide band having the first cut lines, the second guide band having the second cut lines, and the third guide band having the third cut lines in order from the upper end portion side. Since the first cut lines and the third cut lines are inclined in the direction opposite the direction of the second cut lines with respect to the transverse direction, it is possible to prevent the direction of cut-opening guided by the second cut line, from being changed after the cut-opening has passed through the second guide band, and to prevent the cut-opening from progressing to the outside of the first guide band and the third guide band. In addition, the fourth cut line extending along the transverse direction is provided between the first guide band and the second guide band and/or between the second guide band and the third guide band, it is possible to cause cut-opening to progress along the fourth cut line while preventing the cut-opening from progressing to the outside of the first guide band and the third guide band.

In addition, since the first cut lines, the second cut lines, and the third cut lines on the front surface and the first cut lines, the second cut lines, and the third cut lines on the back surface are inclined in the opposite directions with respect to the transverse direction, respectively, cut-opening routes can be set to be different between the front surface and the back surface. For this reason, it is possible to easily take out a packaging article by stabilizing a size of a grip portion after unsealing, and it is possible to sufficiently prevent cut-opening from deviating from the cutting guide band, and progressing in an unexpected direction during unsealing.

In addition, since the fourth cut line is perforated, and the first cut lines, the second cut lines, the third cut lines, and the fourth cut line are spaced apart from each other, surface layers of the first laminated film portion and the second laminated film portion can be prevented from being torn. Accordingly, a variation in cut-opening route can be sufficiently prevented. Therefore, it is possible to sufficiently prevent cut-opening from deviating from the cutting guide band, and progressing in an unexpected direction during unsealing. In addition, compared to cut lines that have a straight shape instead of being perforated, a cut end formed after cut-opening can be prevented from being sharp, and safety can be enhanced.

In the packaging bag, it is preferable that a disposition of the fourth cut line is different between the front surface and the back surface. At this time, it is preferable that the front surface has the fourth cut line between the second guide band and the third guide band, and when viewed along the transverse direction, both the second cut lines and the third cut lines are inclined toward the fourth cut line. It is preferable that the back surface has the fourth cut line between the first guide band and the second guide band, and when viewed along the transverse direction, both the first cut lines and the second cut lines are inclined toward the fourth cut line. Accordingly, cut-opening routes on the front surface and on the back surface are more likely to be different from each other, and the grip portion can be more reliably formed after unsealing. In addition, it is possible to maintain strength of the first laminated film portion and the second laminated film portion by reducing the number of the fourth cut lines.

It is preferable that on the front surface of the packaging bag, an imaginary line being parallel to the transverse direction and passing through lower ends of the plurality of first cut lines intersects at least some of the second cut lines that are perforated, and on the back surface of the packaging bag, an imaginary line being parallel to the transverse direction and passing through upper ends of the plurality of third cut lines intersects at least some of the second cut lines that are perforated. Accordingly, even when cut-opening is started from a side end portion opposite an expected side end portion, it is possible to cause the cut-opening to progress along the vicinity of the imaginary lines on the front surface and on the back surface. Therefore, even when cut-opening is started from a side end portion side different from an expected side, it is possible to sufficiently prevent the cut-opening from deviating from the cutting guide band, and progressing in an unexpected direction during unsealing.

It is preferable that in the packaging bag, the second cut lines of the front surface and the second cut lines of the back surface are disposed offset from each other in an up-down direction. Accordingly, it is possible to sufficiently increase the grip portion after unsealing by further increasing an offset between cut-opening routes of the front surface and the back surface.

It is preferable that a width of the cutting guide band is 4 mm or more. When the cutting guide band is provided, and then a notch is provided in the side end portion, the notch can be prevented from being provided offset from the cutting guide band by sufficiently increasing the width of the cutting guide band. Accordingly, cut-opening from the notch can be further prevented from being offset from the cutting guide band.

It is preferable that the cutting guide band extends from the one side end portion to the other side end portion of the packaging bag, and the second guide band includes notches at the side end portions. Accordingly, it is possible to cause cut-opening to progress from the second guide band with higher reliability. Therefore, it is possible to sufficiently prevent the cut-opening from deviating from the cutting guide band while stably forming the grip portion.

It is preferable that the packaging bag further includes a containing portion that contains a packaging article; and a sealing portion that is provided between the containing portion and the cutting guide band, and that is configured to seal the containing portion along the cutting guide band after unsealing. Accordingly, it is possible to repeatedly perform unsealing and sealing of the containing portion, and it is possible to sufficiently prevent a change in properties of the packaging article that is not consumed at once.

It is preferable that each of the first laminated film portion and the second laminated film portion has a lamination structure in which a sealant layer, a barrier layer containing an inorganic substance, a polyethylene resin layer, and a base material layer are laminated in order from an inside. Since the polyethylene resin layer is provided between the barrier layer and the base material layer, the first laminated film portion and the second laminated film portion have flexibility, so that it is possible to sufficiently prevent cut-opening from progressing in an unexpected direction while having sufficient strength.

A tear strength of each of the first laminated film portion and the second laminated film portion when being torn along the cutting guide band is preferably 0.1 to 2.0 N, more preferably 0.2 to 0.9 N. Accordingly, the cutting guide band can be torn with an appropriate force while maintaining sufficient strength. The tear strength in the present disclosure is a value measured in accordance with JIS K 7128-1:1998.

The present disclosure provides a packaging body including: any one of the packaging bags described above; and a patch contained in the containing portion of the packaging bag. Since the packaging body includes any one of the packaging bags described above, it is possible to sufficiently prevent cut-opening from deviating from the cutting guide band, and progressing in an unexpected direction during unsealing. Therefore, the patch can be smoothly taken out from the packaging body. In addition, since damage to the packaging bag caused by unsealing can be prevented, a packaging article can be sealed and stored again even after the packaging bag is unsealed once. Therefore, it is possible to maintain the effectiveness of the patch at a high level for a long period of time even after unsealing.

Advantageous Effects of Invention

According to the present disclosure, it is possible to provide the packaging bag capable of sufficiently preventing cut-opening from deviating from the cutting guide band, and progressing in an unexpected direction during unsealing. In addition, it is possible to provide the packaging body including such a packaging bag.

DESCRIPTION OF EMBODIMENTS

Figure 1:
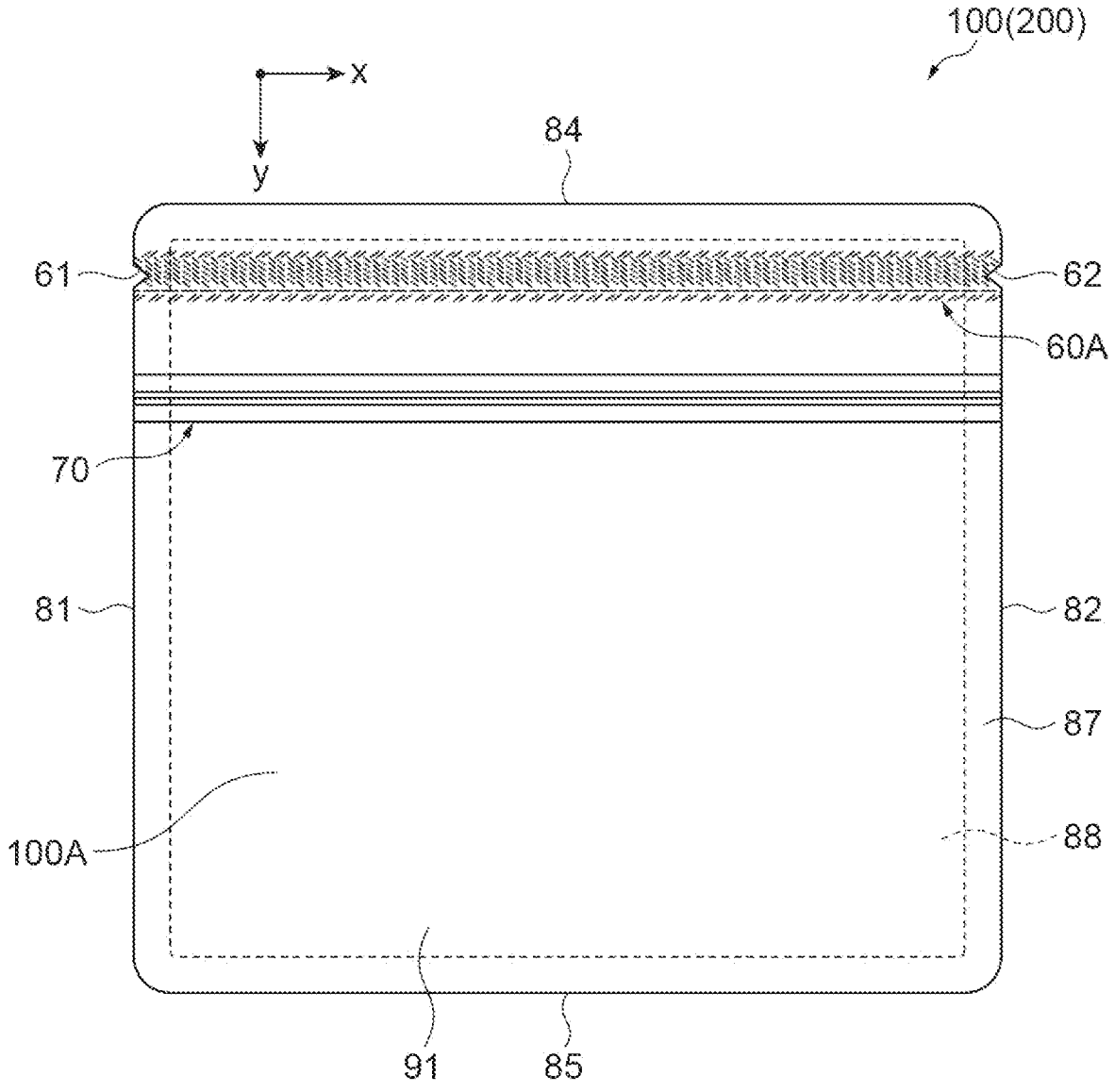
FIG. 1 is a plan view showing a front surface side of a packaging bag and a packaging body according to one embodiment.

Hereinafter, embodiments of the present disclosure will be described with reference to the drawings according to circumstances. However, the following embodiments will be provided as examples for describing the present disclosure, and are not intended to limit the present disclosure to the following contents. In the description, the same elements or elements having the same function are denoted by the same reference signs, and duplicate description will not be repeated. In addition, unless otherwise specified, positional relationships such as up, down, left, and right used in the description are based on positional relationships shown in the drawings.

Figure 2:
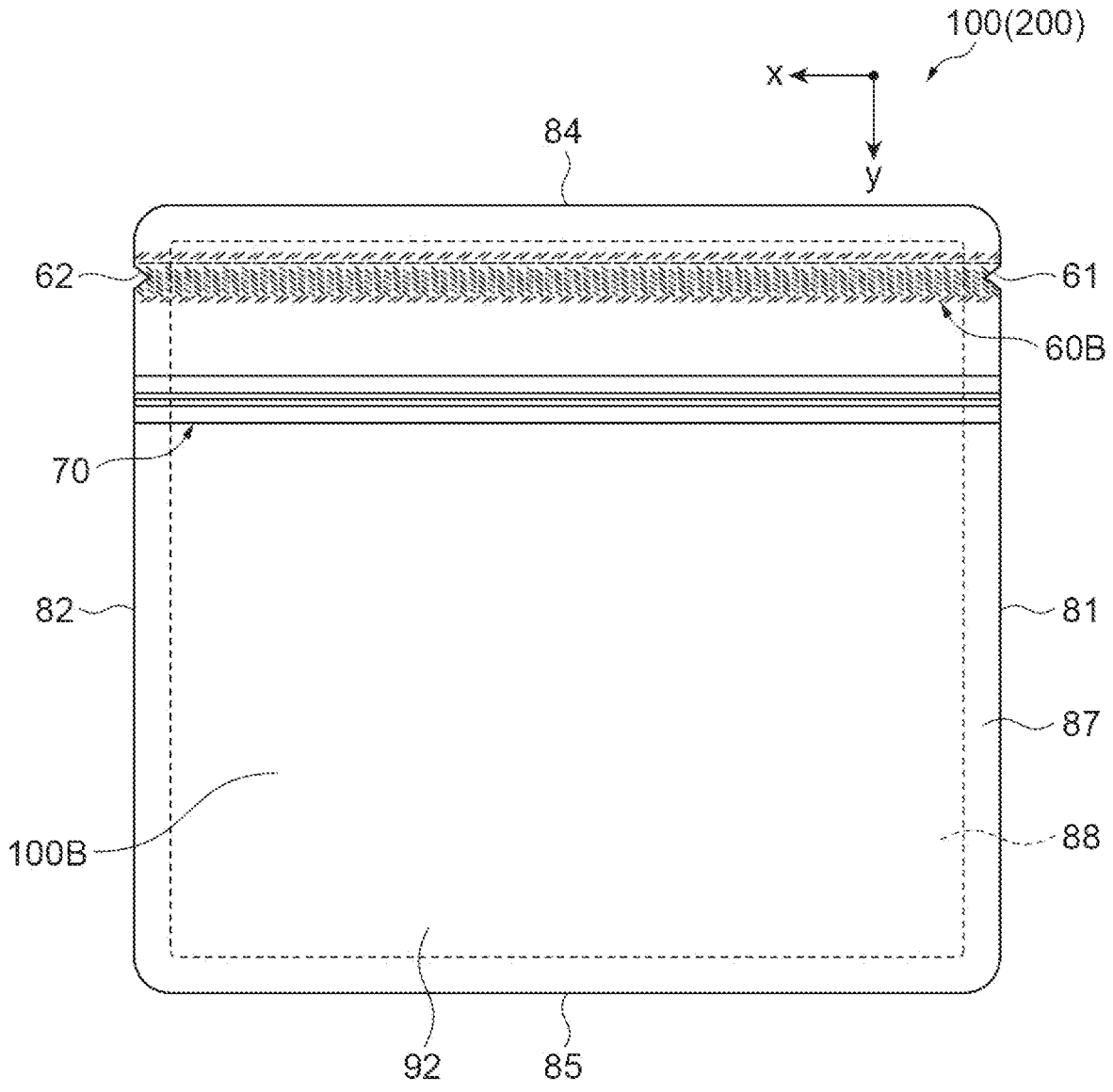
FIG. 2 is a plan view showing a back surface side of the packaging bag and the packaging body according to one embodiment.

FIG. 1 is a plan view showing a front surface 100A side of a packaging bag 100 according to one embodiment. FIG. 2 is a plan view showing a back surface 100B side of the packaging bag 100. Each of a laminated film portion 91 (first laminated film portion) on the front surface side and a laminated film portion 92 (second laminated film portion) on the back surface side is formed of laminated films. The packaging bag 100 includes a sealed portion 87 formed by pasting together peripheral edges of the laminated film portions 91 and 92 each having a substantially rectangular shape, and a containing portion 88 formed between the laminated film portions 91 and 92 inside the sealed portion 87. Namely, the sealed portion 87 pastes together the laminated film portions 91 and 92 at an upper end portion 84, side end portions 81 and 82, and a lower end portion 85 of the packaging bag 100. The containing portion 88 contains, for example, a packaging article such as a medicine such as a patch and foodstuffs.

The packaging bag 100 includes a cutting guide band 60A and a cutting guide band 60B for cut opening and unsealing the packaging bag 100 at upper portions of the front surface 100A and the back surface 100B, respectively, so as to cross between one side end portion 81 and the other side end portion 82. The cutting guide band 60A and the cutting guide band 60B extend from the one side end portion 81 to the other side end portion 82. Notches 61 and 62 for start of cut-opening, each having a V shape, are formed in the side end portions 81 and 82, respectively. The notches 61 and 62 are formed inside the cutting guide band 60A and the cutting guide band 60B.

When cut-opening is started from the notch 61, the cut-opening progresses along a transverse direction from the one side end portion 81 toward the other side end portion 82 (x direction in FIGS. 1 and 2), and the upper end portion 84 is cut away from the packaging bag 100. Since the cutting guide bands 60A and 60B of the packaging bag 100 include the notch 62 at the other side end portion 82, the upper end portion 84 can also be cut away from the packaging bag 100 by allowing cut-opening to progress along a direction opposite the transverse direction. Incidentally, since cut-opening progresses smoothly when cutting is performed along the transverse direction (x direction), at least one of the cutting guide bands 60A and 60B may have a mark indicating the transverse direction as a cutting direction.

A sealing portion 70 that seals the containing portion 88 again after the packaging bag 100 is unsealed by the cutting guide bands 60A and 60B is provided below the cutting guide bands 60A and 60B. The sealing portion 70 can appropriately employ a known structure in which unsealing and sealing can be repeatedly performed. For example, the sealing portion 70 may be a fastener made of synthetic resin and being capable of repeatedly performing sealing by fitting a band-shaped protrusion portion and a band-shaped groove portion to each other, or may be an adhesive seal.

Figure 3:
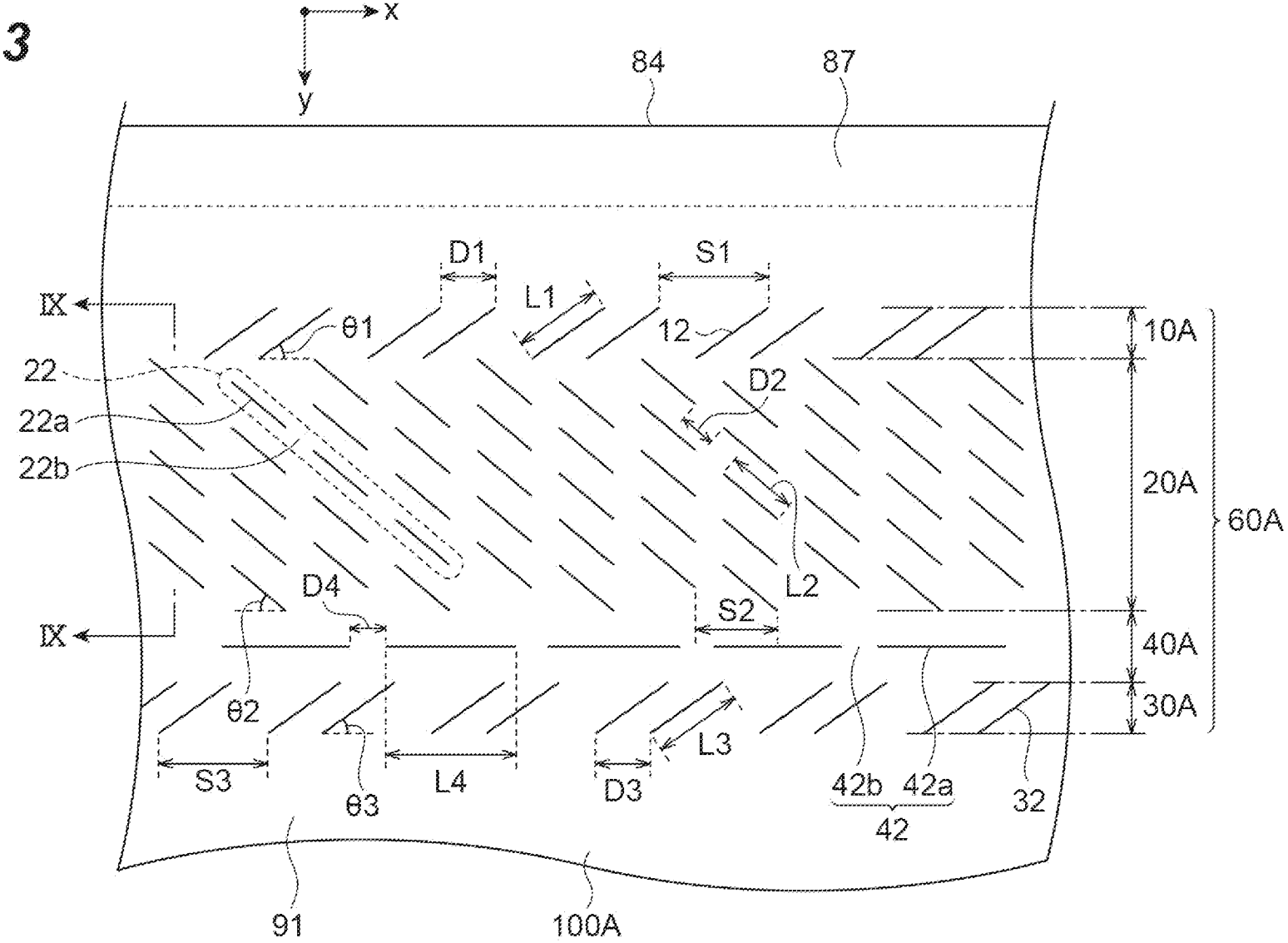
FIG. 3 is an enlarged plan view showing a part of a cutting guide band on a front surface of the packaging bag and the packaging body according to one embodiment.
Figure 4:
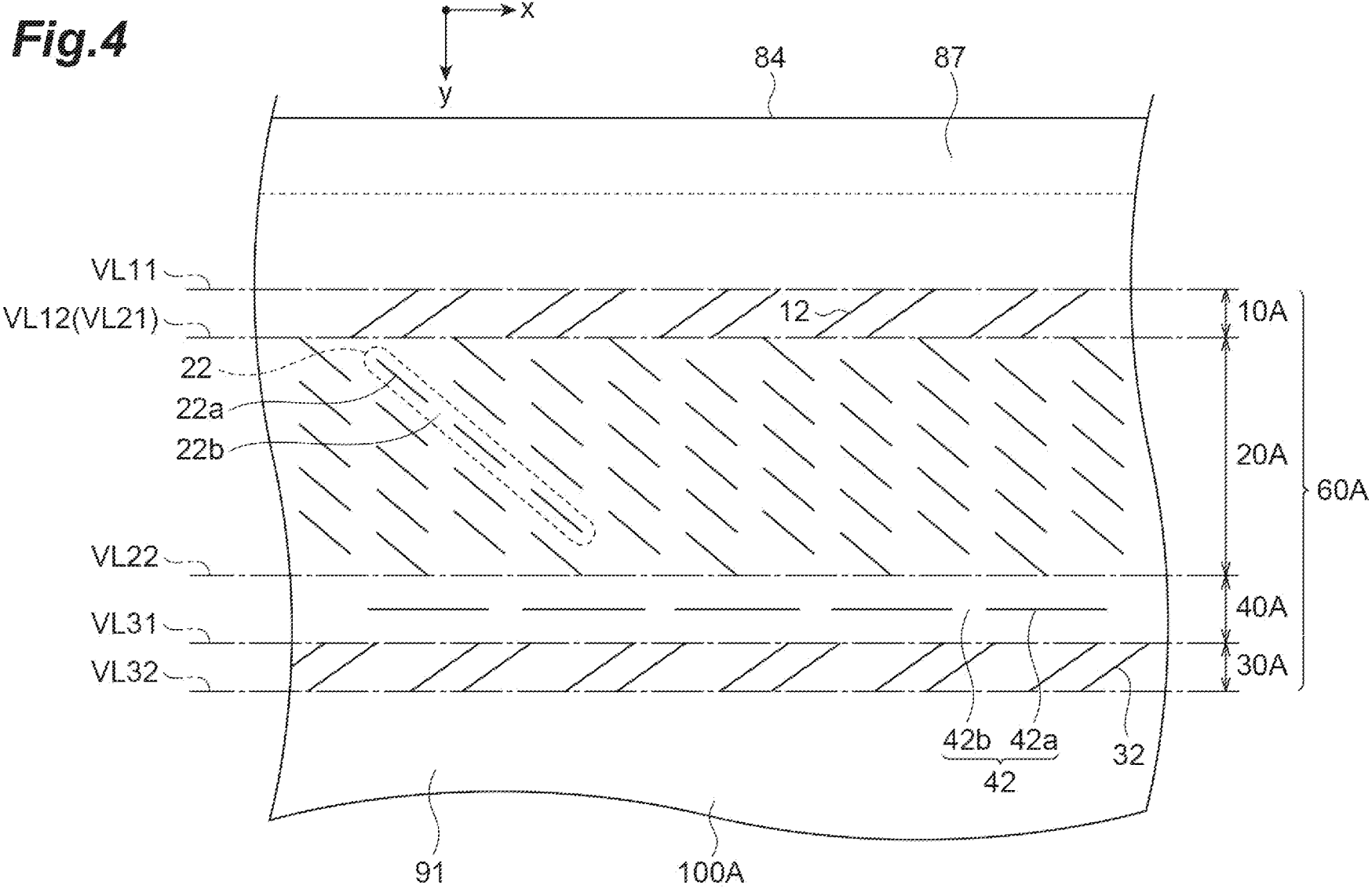
FIG. 4 is a view showing a region of each guide band of the cutting guide band shown in FIG. 3.

FIG. 3 is an enlarged plan view showing a part of the cutting guide band 60A on the front surface 100A of the packaging bag 100. FIG. 4 is a view showing a region of each guide band of the cutting guide band 60A. The cutting guide band 60A includes a first guide band 10A, a second guide band 20A, a fourth guide band 40A, and a third guide band 30A in order from an upper end portion 84 side. The first guide band 10A has a plurality of first cut lines 12 that are inclined at a predetermined angle θ1 with respect to the transverse direction (x direction), and that are arranged parallel to each other. The angle θ1 may be 20 degrees to 50 degrees or 30 degrees to 40 degrees. Accordingly, cut-opening that has entered the first guide band 10A can be smoothly guided toward a central portion of the cutting guide band 60A.

The first cut lines 12 are also referred to as half-cut lines or weak lines, and are formed by making cuts in front surfaces of the laminated film portions 91 and 92 using a metal blade or a laser beam. A second cut line 22, a third cut line 32, and a fourth cut line 42 to be described below are also formed in the same manner. The first guide band 10A is a band-shaped region defined by a pair of imaginary lines VL11 and VL12 (FIG. 4) passing through upper ends and lower ends of the first cut lines 12 and extending parallel to the transverse direction (x direction). A width (length in a y direction) of the first guide band 10A may be 0.2 to 3 mm, 0.4 to 2 mm, or 0.6 to 1 mm.

A length L1 of the first cut lines 12 may be 0.3 to 4 mm, 0.5 to 3 mm, or 1 to 2 mm. The first cut lines 12 having the length L1 can change a cut-opening route with high accuracy while maintaining strength of the packaging bag 100 at a sufficiently high level. The intervals between the first cut lines 12 adjacent to each other may be different from each other. Namely, an interval D1 between the first cut lines 12 that are provided adjacent and close to each other is smaller than an interval S1 between the first cut lines 12 that are provided adjacent to but distant part from each other. Interval S1/interval D1 may be 1.5 to 3 or 1.8 to 2.5. In such a manner, since the first cut lines 12 are provided at different intervals in the first guide band 10A, it is possible to prevent the cut-opening that has once entered the first guide band 10A, from continuing to progress through the first guide band 10A while preventing the cut-opening from easily protruding into the first guide band 10A. However, in a modification example, the first cut lines 12 may be arranged at equal intervals.

The second guide band 20A has a plurality of the second cut lines 22 that are perforated, that are inclined at a predetermined angle θ2 in a direction opposite that of the first cut lines 12 with respect to the transverse direction (x direction), and that are arranged parallel to each other at equal intervals. The angle θ2 of the second cut lines 22 inclined with respect to the transverse direction (x direction) may be 25 degrees to 55 degrees or 30 degrees to 50 degrees. Accordingly, cut-opening that has entered the second guide band 20A can be smoothly guided along the transverse direction.

The second cut lines 22 are perforated straight, and line portions 22*a* and non-line portions 22*b* having a shorter length than that of the line portions 22*a* are alternately arranged to form perforations. Since the second cut lines 22 are perforated, it is possible to prevent a surface layer of the laminated film portion 91 from being torn while allowing smooth progress of cut-opening. From the same viewpoint, a length L2 of the line portions 22*a* of the second cut lines 22 that are perforated may be 0.3 to 3 mm or 0.5 to 2 mm. In addition, an interval D2 between the line portions 22*a* (length of the non-line portions 22*b*) may be 0.1 to 1.2 mm or 0.3 to 1.0 mm. An interval S2 between the second cut lines 22 adjacent to each other that are perforated may be 0.1 to 1.2 mm or 0.3 to 1.0 mm. A length of one second cut line 22 that is perforated may be 4 to 10 mm or 5 to 9 mm. In a modification example, the intervals between the second cut lines 22 adjacent to each other that are perforated may be different from each other instead of being constant.

Since the second cut lines 22 are disposed at a center of the cutting guide band 60A, and have a function of guiding cut-opening in the second guide band 20A to the fourth cut line 42 to be described later, it is preferable that the number of the second cut lines 22 is larger than the number of the first cut lines 12 and of the third cut lines 32. The number of the second cut lines 22 that are perforated may be equal to or more than 1.5 times the number of the first cut lines 12 and of the third cut lines 32.

The line portions 22*a* of the second cut lines 22 adjacent to each other may be arranged along an up-down direction (y direction) at constant intervals. In this case, it is preferable that five or more line portions 22*a* are arranged along the up-down direction (y direction). Accordingly, even when the width of the second guide band 20A is increased, cut-opening can be smoothly guided. When the width of the second guide band 20A is increased, it is easy to form the notches 61 and 62 so as to include the second guide band 20A.

The second guide band 20A is a band-shaped region defined by a pair of imaginary lines VL21 and VL22 (FIG. 4) passing through upper ends and lower ends of the second cut lines 22 and extending parallel to the transverse direction (x direction). As shown in FIGS. 3 and 4, when the positions of the upper ends of the second cut lines 22 are different from each other, the upper imaginary line VL21 is drawn to pass through the upper ends of the second cut lines 22 located at an uppermost position. In addition, when the positions of the lower ends of the second cut lines 22 are different from each other, the imaginary line VL22 is drawn to pass through the lower ends of the second cut lines 22 located at a lowermost position. The width (length in the y direction) of the second guide band 20A may be 2 to 8 mm, 3 to 7 mm, or 4 to 6 mm. The first guide band 10A and the second guide band 20A adjacent to each other may be in direct contact with each other. Namely, the imaginary line VL12 passing through the lower ends of the first cut lines 12 may pass through the upper ends of at least some of the second cut lines 22. In this case, as shown in FIG. 4, the imaginary line VL12 and the imaginary line VL21 are drawn at the same position. The imaginary line VL12 and the imaginary line VL21 may be separated from each other, or a part of the first guide band 10A and a part of the second guide band 20A may overlap each other. In this case, the imaginary line VL12 passing through the lower ends of the first cut lines 12 may intersect at least some of the second cut lines 22.

The third guide band 30A has a plurality of the third cut lines 32 that are inclined at a predetermined angle θ3 in the same direction as that of the first cut lines 12 with respect to the transverse direction (x direction), and that are arranged parallel to each other. Conditions such as the disposition, the shape, the size, and the interval between the third cut lines 32 may be the same as or different from those of the first cut lines 12. The angle θ3 of the third cut lines 32 inclined with respect to the transverse direction (x direction) may be 20 degrees to 50 degrees or 30 degrees to 40 degrees. Accordingly, cut-opening that has entered the third guide band 30A can be smoothly guided toward the central portion of the cutting guide band 60A. The angle θ3 may be equal to or different from the angle θ1.

The third guide band 30A is a band-shaped region defined by a pair of imaginary lines VL31 and VL32 passing through upper ends and lower ends of the third cut lines 32 and extending parallel to the transverse direction (x direction). A width (length in the y direction) of the third guide band 30A may be 0.2 to 3 mm, 0.4 to 2 mm, or 0.6 to 1 mm.

A length L3 of the third cut lines 32 may be 0.3 to 4 mm, 0.5 to 3 mm, or 1 to 2 mm. The third cut lines 32 having the length L3 can change a cut-opening route with high accuracy while maintaining strength of the packaging bag 100 at a sufficiently high level. The intervals between the third cut lines 32 adjacent to each other may be different from each other. Namely, an interval D3 between the third cut lines 32 that is provided adjacent and close to each other is smaller than an interval S3 between the third cut lines 32 that are provided adjacent to but distant from each other. Interval S3/interval D3 may be 1.5 to 3 or 1.8 to 2.5. In such a manner, since the third cut lines 32 are provided at different intervals in the third guide band 30A, it is possible to prevent the cut-opening that has once entered the third guide band 30A, from continuing to progress through the third guide band 30A while preventing the cut-opening from easily intruding into the third guide band 30A. However, in a modification example, the third cut lines 32 may be arranged at equal intervals.

The cutting guide band 60A includes the fourth guide band 40A between the second guide band 20A and the third guide band 30A, the fourth guide band 40A including one fourth cut line 42 that is perforated and that extends along the transverse direction (x direction). The fourth guide band 40A is a region between the second guide band 20A and the third guide band 30A, and is a band-shaped region defined by the imaginary line VL22 passing through the lower ends of the second cut lines 22 and extending parallel to the transverse direction (x direction), and by the imaginary line VL31 passing through the upper ends of the third cut lines 32 and extending parallel to the transverse direction (x direction). Since the fourth cut line 42 extends along the transverse direction (x direction), it is possible to prevent cut-opening from deviating from the cutting guide band 60A, and progressing in an unexpected direction. The fourth cut line 42 is perforated straight, and line portions 42*a* and non-line portions 42*b* having a shorter length than that of the line portion 42*a* are alternately arranged to form perforations.

Since the fourth cut line 42 is perforated, it is possible to prevent the surface layer of the laminated film portion 91 from being torn while allowing smooth progress of cut-opening. In addition, a cut end formed after cut-opening can be prevented from being sharp, and safety can be enhanced. From the same viewpoint, a length L4 of the line portions 42*a* of the fourth cut line 42 that is perforated may be 1 to 5 mm or 1.5 to 4 mm. A length D4 of the non-line portions 42*b* may be 0.1 to 1.2 mm or 0.3 to 1.0 mm. The fourth cut line 42 that is perforated may extend from the one side end portion 81 to the other side end portion 82 to cross the front surface 100A.

The fourth cut line 42 is provided between the second guide band 20A and the third guide band 30A, but the fourth cut line 42 is provided apart from the second cut lines 22 and from the third cut lines 32. Namely, the first cut lines 12, the second cut lines 22 that are perforated, the third cut lines 32, and the fourth cut line 42 are provided apart from each other. Accordingly, the surface layer of the laminated film portion 91 can be prevented from being torn. Particularly, since the fourth cut line 42 is a longest perforated cut line among the first cut lines 12, the second cut lines 22, the third cut lines 32, and the fourth cut line 42, the surface layer is easily torn in a region adjacent to the fourth cut line 42. From the viewpoint of sufficiently preventing such damage, both an interval between the fourth cut line 42 and the second cut lines 22 and an interval between the fourth cut line 42 and the third cut lines 32 are preferably 0.3 mm or more, more preferably 0.4 mm or more. From the viewpoint of maintaining sufficiently good cutting quality during cut-opening, both the intervals may be 2 mm or less or 1 mm or less. The intervals are obtained as a shortest distance between the lower ends of the second cut lines 22 (lower ends of the line portions 22*a* located at a lowermost position) and the line portions 42*a* of the fourth cut line 42, and a shortest distance between the upper ends of the third cut lines 32 and the line portions 42*a* of the fourth cut line 42.

It is preferable that one fourth cut line 42 that is perforated is provided on the front surface 100A. Accordingly, it is possible to prevent the surface layer of the laminated film portion 91 from being torn while maintaining strength of the cutting guide band 60A.

When viewed along the transverse direction (x direction), both the second cut lines 22 that are perforated and the third cut lines 32 on the front surface 100A are inclined toward the fourth cut line 42. For this reason, the second cut lines 22 that are perforated and the third cut lines 32 function to cause cut-opening progressing in the transverse direction, to converge to the fourth cut line 42. On the other hand, when viewed along the transverse direction (x direction), the first cut lines 12 are inclined away from the fourth cut line 42. The first cut lines 12 have a function of preventing cut-opening from deviating from the cutting guide band 60A to the upper end portion 84 side when the cut-opening progresses in the direction opposite the transverse direction (x direction). In this case, the cut-opening may progress in the vicinity of a boundary between the first guide band 10A and the second guide band 20A.

Figure 5:
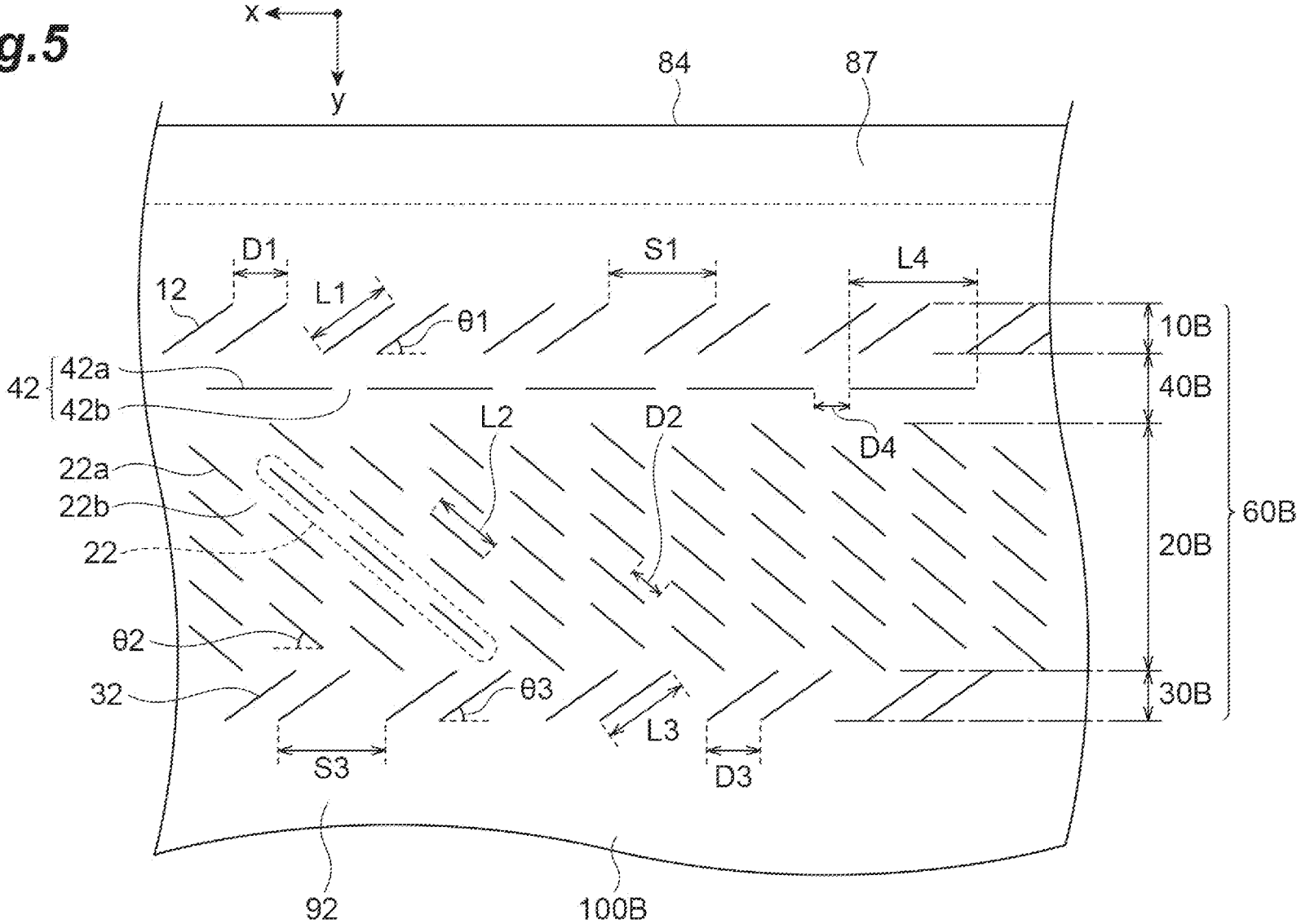
FIG. 5 is an enlarged plan view showing a part of a cutting guide band on a back surface of the packaging bag and the packaging body according to one embodiment.

FIG. 5 is an enlarged plan view showing a part of the cutting guide band 60B on the back surface 100B of the packaging bag 100. The cutting guide band 60B includes a first guide band 10B, a fourth guide band 40B, a second guide band 20B, and a third guide band 30B in order from the upper end portion 84 side. The cutting guide band 60B is different from the cutting guide band 60A on the front surface 100A in that the cutting guide band 60B includes the fourth guide band 40B between the first guide band 10B and the second guide band 20B instead of including the fourth guide band 40B between the second guide band 20B and the third guide band 30B. Namely, in the packaging bag 100, positional relationships in the up-down direction between the second guide bands 20A and 20B and the fourth guide bands 40A and 40B are reversed between the front surface 100A and the back surface 100B. Other configurations of the cutting guide band 60B are the same as those of the cutting guide band 60A. Namely, the first guide band 10B may include the same first cut lines 12 as those of the first guide band 10A. The second guide band 20B may include the same second cut lines 22 as those of the second guide band 20A, the second cut lines 22 being perforated. The third guide band 30B may include the same third cut lines 32 as those of the third guide band 30A.

The fourth guide band 40B may include the same fourth cut line 42 as those of the fourth guide band 40A, the fourth cut line 42 being perforated. The cutting guide band 60B has one fourth cut line 42 between the first guide band 10B and the second guide band 20B, the fourth cut line 42 being perforated and extending along the transverse direction (x direction). Since the fourth cut line 42 extends along the transverse direction (x direction), it is possible to prevent cut-opening from deviating from the cutting guide band 60B, and progressing in an unexpected direction. The fourth cut line 42 is perforated straight, and the line portions 42*a* and the non-line portions 42*b* having a shorter length than that of the line portion 42*a* are alternately arranged to form perforations.

The first cut lines 12 on the back surface 100B and the first cut lines 12 on the front surface 100A are inclined in opposite directions with respect to the transverse direction (x direction). Namely, with movement in the transverse direction (x direction), the first cut lines 12 on the back surface 100B are directed downward, and the first cut lines 12 on the front surface 100A are directed upward. In the present disclosure, "being inclined in opposite directions with respect to the transverse direction" refers to a case where directions in which two types of cut lines are directed are opposite to each other, namely, up and down with movement in the transverse direction (x direction) in such a manner. On the other hand, "being inclined in the same direction with respect to the transverse direction" refers to a case where directions in which two types of cut lines are directed are inclined in an up direction or in a down direction with movement in the transverse direction (x direction).

Similarly to the first cut lines 12, the second cut lines 22 on the back surface 100B and the second cut lines 22 on the front surface 100A are inclined in opposite directions with respect to the transverse direction (x direction). The third cut lines 32 on the back surface 100B and the third cut lines 32 on the front surface 100A are also inclined in opposite directions with respect to the transverse direction (x direction). In such a manner, since the cut lines are inclined in the opposite directions with respect to the transverse direction (x direction), when the packaging bag is cut open along the transverse direction, a grip portion can be formed.

In a plan view of the packaging bag 100, the cutting guide band 60A and the cutting guide band 60B provided on the front surface 100A and on the back surface 100B, respectively, are provided to overlap each other. However, in a plan view, the fourth cut line 42 on the front surface 100A and the fourth cut line 42 on the back surface 100B are provided not to overlap each other. For this reason, when the packaging bag is cut open, cut-opening routes on the front surface 100A and on the back surface 100B can be set to be different from each other with higher reliability. For this reason, the grip portion can be stably formed.

The width of the cutting guide bands 60A and 60B (length in the y direction in FIGS. 3 and 5) is preferably 4 mm or more, more preferably 6 mm or more, and further preferably 7 mm or more. Accordingly, when the cutting guide bands 60A and 60B are provided, and then the notches 61 and 62 are provided in the side end portions 81 and 82, the notches 61 and 62 can be prevented from being provided offset from the cutting guide bands 60A and 60B. An upper limit of the width of the cutting guide bands 60A and 60B may be, for example, 20 mm.

In a plan view of the packaging bag 100, the second cut lines 22 on the front surface 100A and the second cut lines 22 on the back surface 100B are disposed offset from each other in the up-down direction. Namely, the second guide band 20A on the front surface 100A and the second guide band 20B on the back surface 100B are disposed offset from each other in the up-down direction. Accordingly, it is possible to sufficiently increase the grip portion after unsealing by further increasing an offset between the cut-opening routes of the front surface 100A and the back surface 100B. In a plan view of the packaging bag 100, the fourth guide band 40A (region between the second guide band 20A and the third guide band 30A) on the front surface 100A and at least a part of the second guide band 20B on the back surface 100B overlap each other. Accordingly, the progress of cut-opening in the fourth guide band 40A can be made even smoother. Similarly, in a plan view of the packaging bag 100, the fourth guide band 40B (region between the first guide band 10B and the second guide band 20B) on the back surface 100B and at least a part of the second guide band 20A on the front surface 100A overlap each other. Accordingly, the progress of cut-opening in the fourth guide band 40B can be made even smoother.

Figure 6:
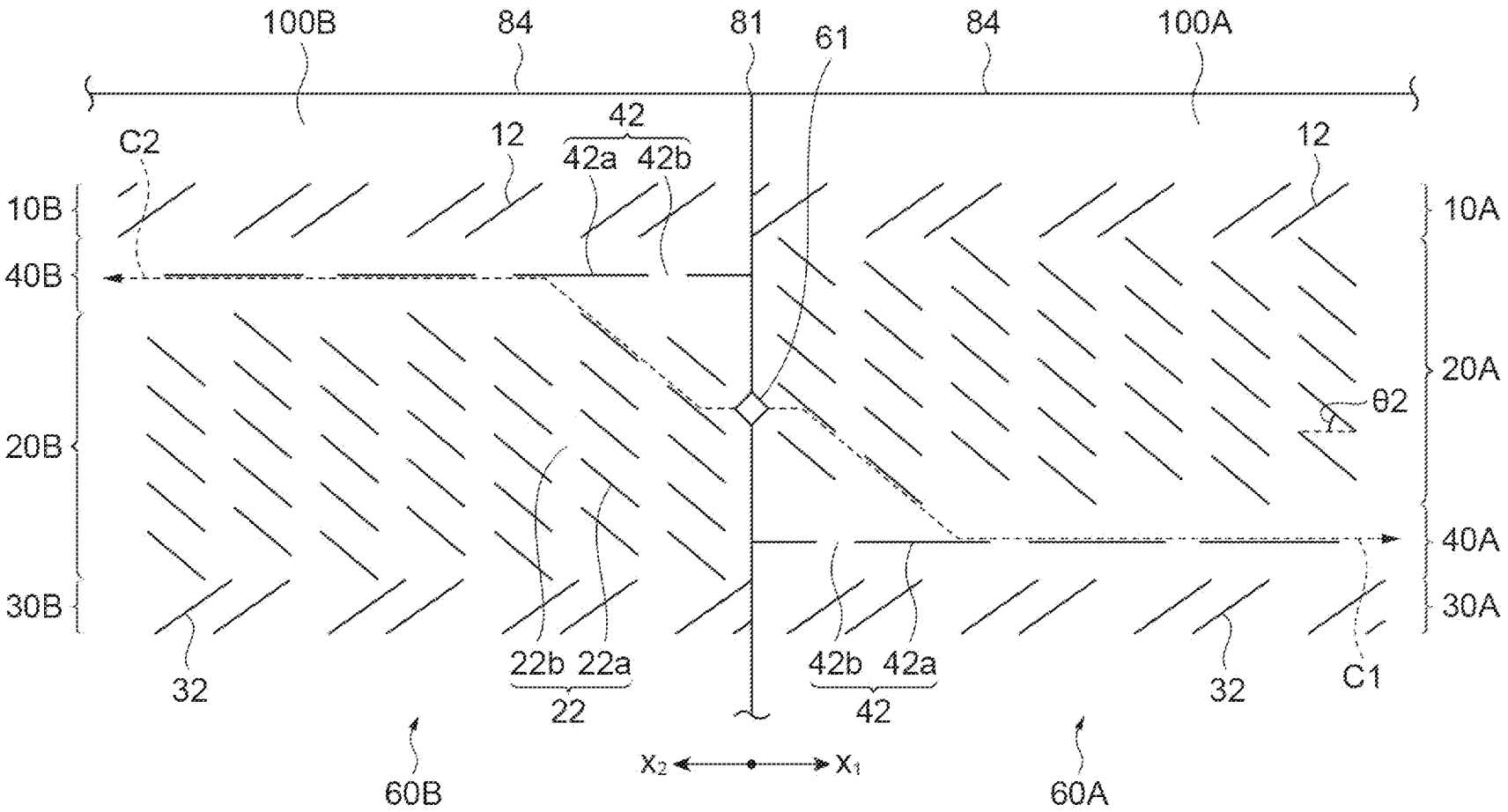
FIG. 6 is a view of the packaging bag and the packaging body when being unfolded by cutting the other side end portion according to one embodiment.

FIG. 6 is an unfolded view of the packaging bag 100 schematically showing cutting lines C1 and C2 when the packaging bag 100 is cut open from the one side end portion 81 with the notch 61 as a starting point. FIG. 6 is a view of the packaging bag 100 when being unfolded by cutting the other side end portion 82. The cutting guide bands 60A and 60B include the notch 61 at the one side end portion 81. When cut-opening is started from the notch 61, on both the front surface 100A and the back surface 100B, first, a tip of the cut-opening progresses in the transverse direction ($x_1$ and $x_2$ directions), and then reaches the second cut line 22. Thereafter, on the front surface 100A, the tip of the cut-opening is guided by the second cut line 22 to bend downward and then to reach the fourth cut line 42. Thereafter, the tip of the cut-opening progresses on the fourth cut line 42 that is perforated, to form the cutting line C1. On the other hand, on the back surface 100B, the tip of the cut-opening bends upward to reach the fourth cut line 42. Thereafter, the tip of the cut-opening progresses on the fourth cut line 42 that is perforated, to form the cutting line C2. Since the cutting line C1 and the cutting line C2 are not line-symmetric with respect to the side end portion 81 as an axis, the grip portion can be formed.

Figure 7:
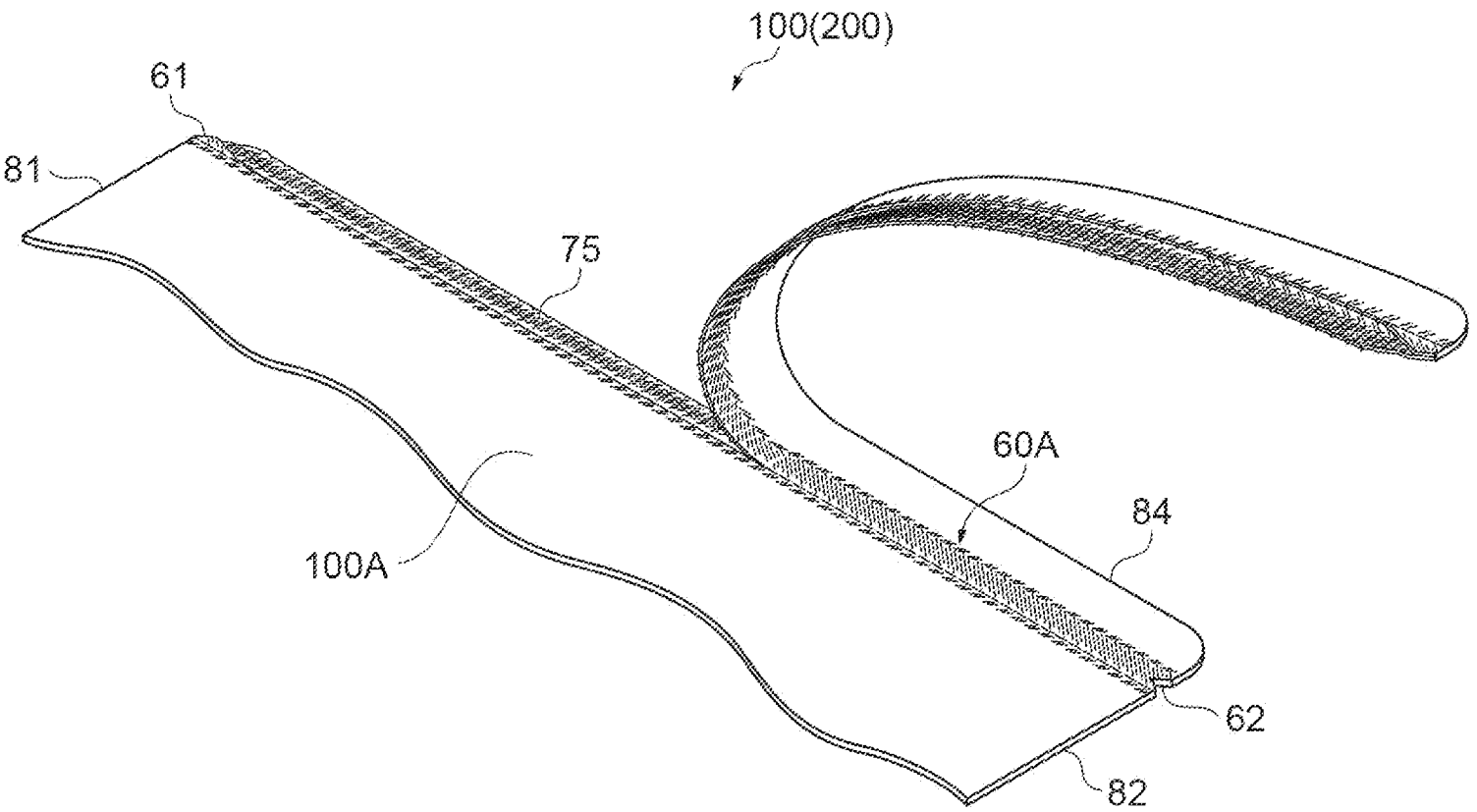
FIG. 7 is a view showing a state of the packaging bag and the packaging body when being cut open from one side end portion along the cutting guide bands according to one embodiment.

FIG. 7 is a view showing a state of the packaging bag 100 when being cut open from the one side end portion 81 along the cutting guide bands 60A and 60B. A grip portion 75 is formed in the packaging bag 100 by cut opening the packaging bag 100 along the cutting guide bands 60A and 60B. When the grip portion 75 is gripped with the fingers, the packaging article contained in the containing portion of the packaging bag 100 can be easily taken out. Incidentally, FIG. 7 shows a state where the packaging bag 100 is unsealed halfway, but the cut-opening may further progress to cut the upper end portion 84 of the packaging bag 100 away from the packaging bag 100. As shown in FIGS. 1 and 2, since the packaging bag 100 includes the sealing portion 70, the packaging article can be sealed and stored.

The packaging bag 100 (packaging body 200) is preferably cut open and unsealed from the one side end portion 81, but can be cut open and unsealed from the other side end portion 82.

Figure 8:
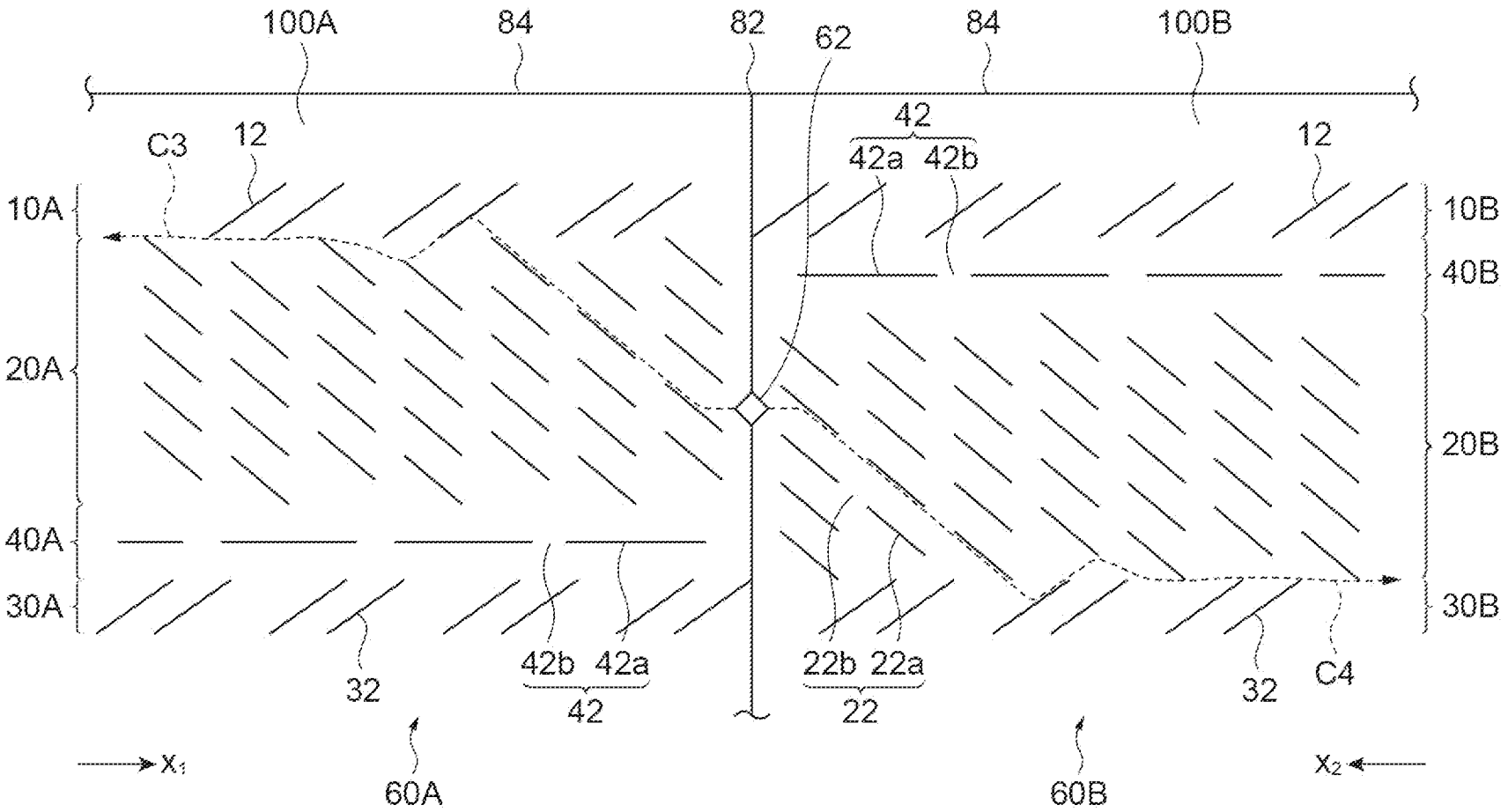
FIG. 8 is a view of the packaging bag and the packaging body when being unfolded by cutting the one side end portion according to one embodiment.

FIG. 8 is an unfolded view of the packaging bag 100 schematically showing cutting lines C3 and C4 when the packaging bag 100 is cut open from the other side end portion 82 with the notch 62 as a starting point. FIG. 8 is a view of the packaging bag 100 when being unfolded by cutting the one side end portion 81. The cutting guide bands 60A and 60B include the notch 62 at the other side end portion 82. When cut-opening is started from the notch 62, on the front surface 100A and on the back surface 100B, first, a tip of the cut-opening progresses in the direction opposite the transverse direction ($x_1$ and $x_2$ directions), and then reaches the second cut line 22. Thereafter, on the front surface 100A, the tip of the cut-opening is guided by the second cut line 22 to bend upward and then to reach the first cut line 12. Thereafter, the tip of the cut-opening is guided by the first cut line 12 to bend downward and then to reach another second cut line 22. Thereafter, the cut-opening progresses in the vicinity of the boundary between the first guide band 10A and the second guide band 20A to form the cutting line C3. On the other hand, on the back surface 100B, the tip of the cut-opening bends downward to reach the third cut line 32. The tip of the cut-opening is guided by the third cut line 32 to bend upward and then to reach another second cut line 22. Thereafter, the tip of the cut-opening progresses in the vicinity of a boundary between the second guide band 20B and the third guide band 30B to form the cutting line C4. Since the cutting line C3 and the cutting line C4 are not line symmetric with respect to an outer edge of the other side end portion 82 as an axis, the grip portion can be formed.

In such a manner, even when the packaging bag 100 is cut open from one of the side end portions 81 and 82, it is possible to sufficiently prevent the cut-opening from deviating from the cutting guide bands 60A and 60B, and progressing in an unexpected direction during unsealing. In addition, since the grip portion can be stably formed, the packaging article can be smoothly taken out.

Figure 9:
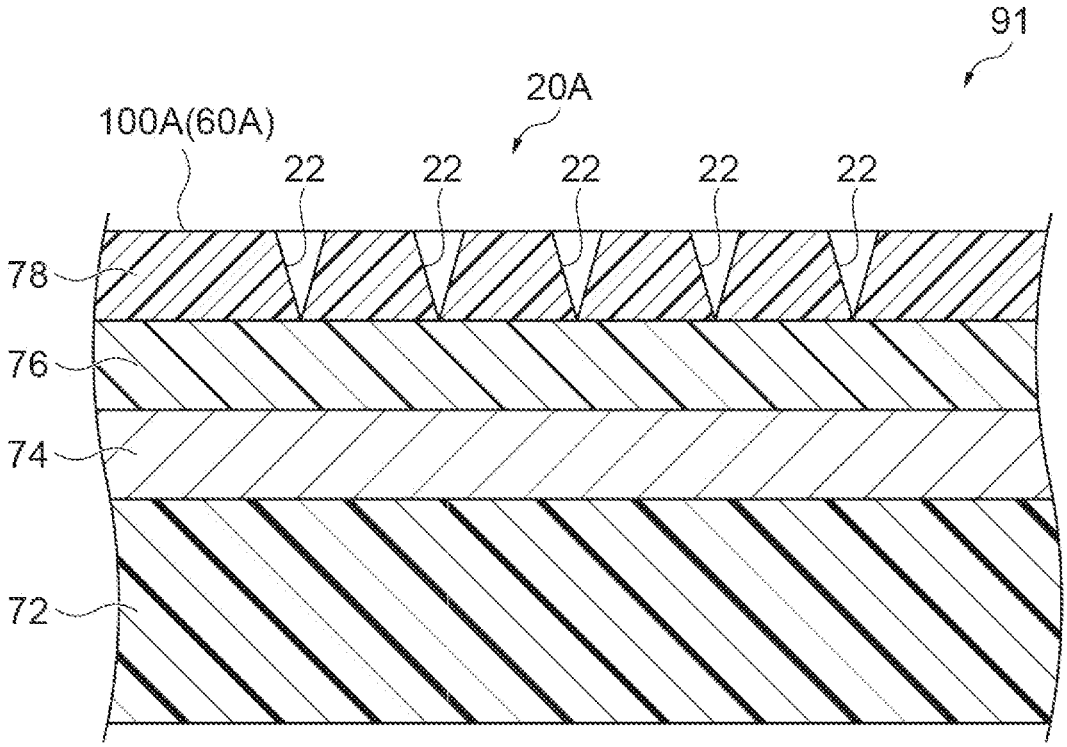
FIG. 9 is a cross-sectional view of a laminated film on a front surface side cut along line IX-IX of FIG. 3.

FIG. 9 is a cross-sectional view of the laminated film portion 91 on a front surface 100A side forming the packaging bag 100 cut along line IX-IX of FIG. 3. The laminated film portion 91 has a lamination structure in which a sealant layer 72, a barrier layer 74 containing an inorganic substance, a polyethylene resin layer 76, and a base material layer 78 are laminated in order from the inside. Since the polyethylene resin layer 76 is provided between the barrier layer 74 and the base material layer 78, the laminated film portion 91 has flexibility, so that unexpected tearing can be prevented from occurring during transport or the like.

Exemplary examples of the sealant layer 72 include a film-shaped polyolefin resin. More specifically, the exemplary examples include ethylene-based resins such as low-density polyethylene resin, medium-density polyethylene resin, linear low-density polyethylene resin, polyethylene terephthalate resin having heat sealability, ethylene-vinyl acetate copolymer, ethylene-α-olefin copolymer, and ethylene-methacrylic acid resin copolymer; blend resin of polyethylene and polybutene; polypropylene-based resins such as homopolypropylene resin, propylene-ethylene random copolymer, propylene-ethylene block copolymer, propylene-α-olefin copolymer, and the like. A thickness of the sealant layer 72 may be 10 to 100 μm.

Exemplary examples of the barrier layer 74 containing an inorganic substance include a deposition film made of an inorganic substance, a metal foil, a resin film, a laminated structure obtained by laminating a deposition layer on a resin film, and the like. Specifically, the exemplary examples include an inorganic deposition film made of silica, an aluminum deposition film, an aluminum foil, an aluminum foil-laminated PET film, and the like. The barrier layer 74 may contain one of these materials alone or a combination of two or more thereof. A thickness of the barrier layer 74 may be 5 to 30 μm.

Exemplary examples of the polyethylene resin layer 76 include a biaxially oriented polyethylene film. A thickness of the polyethylene resin layer 76 may be 10 to 40 μm.

Exemplary examples of the base material layer 78 include paper, biaxially oriented films such as a biaxially oriented polyethylene terephthalate (PET) film, a biaxially oriented polypropylene (PP) film, and a biaxially oriented nylon film. One of the above-described materials may be used alone or two or more thereof may be combined to form the base material layer 78. A thickness of the base material layer 78 may be 10 to 30 μm.

As shown in FIG. 9, the second cut lines 22 in the second guide band 20A are formed by making cuts in the base material layer 78. The first cut lines 12, the third cut lines 32, and the fourth cut line 42 are also formed in the same manner. The laminated film portion 92 (laminated film 92) on the back surface side may also have the same lamination structure as that of the laminated film portion 91 (laminated film 91) on the front surface side. An adhesive layer may be formed between the layers.

Figure 10:
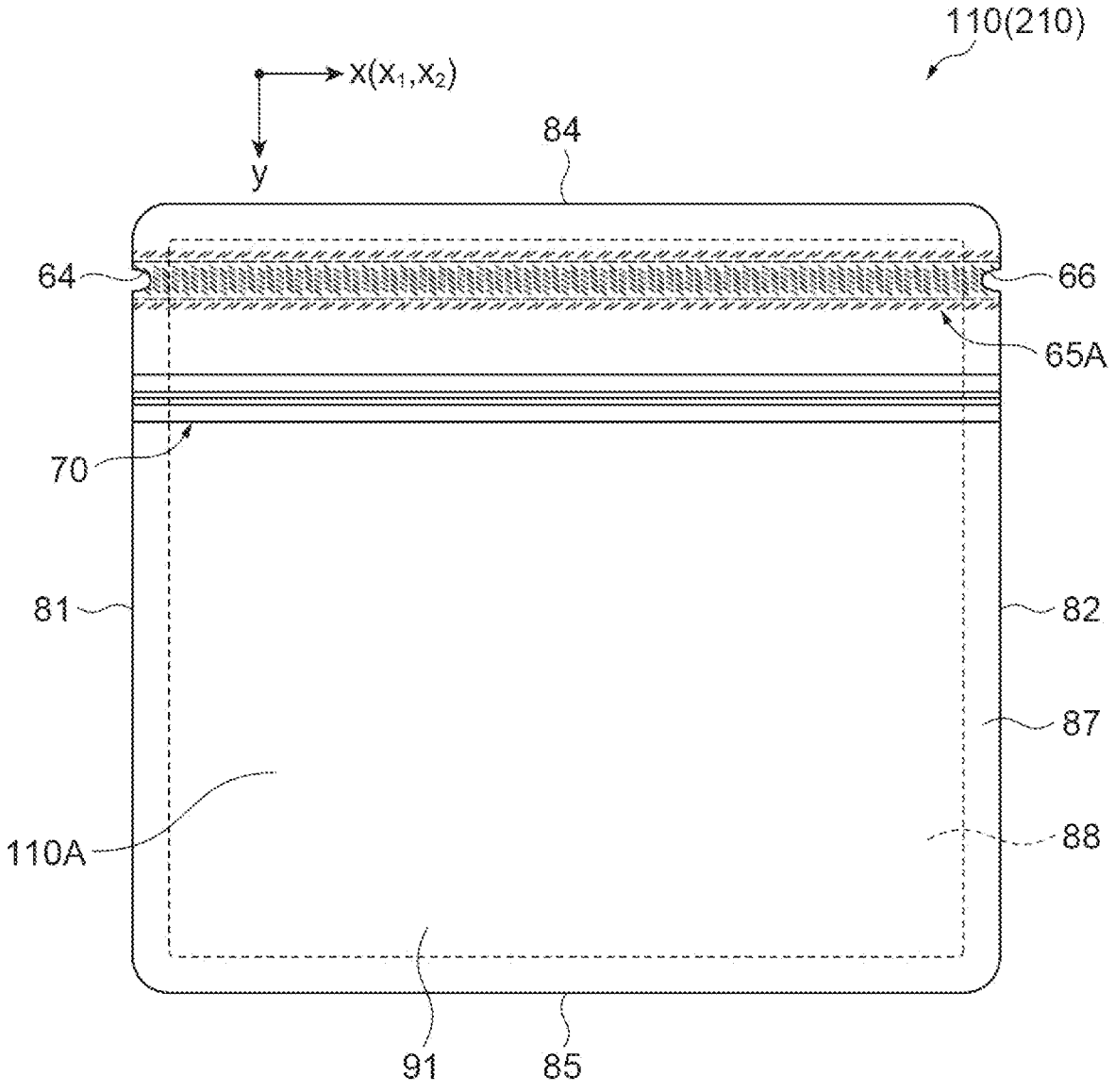
FIG. 10 is a plan view showing a front surface side of a packaging bag and a packaging body according to another embodiment.
Figure 11:
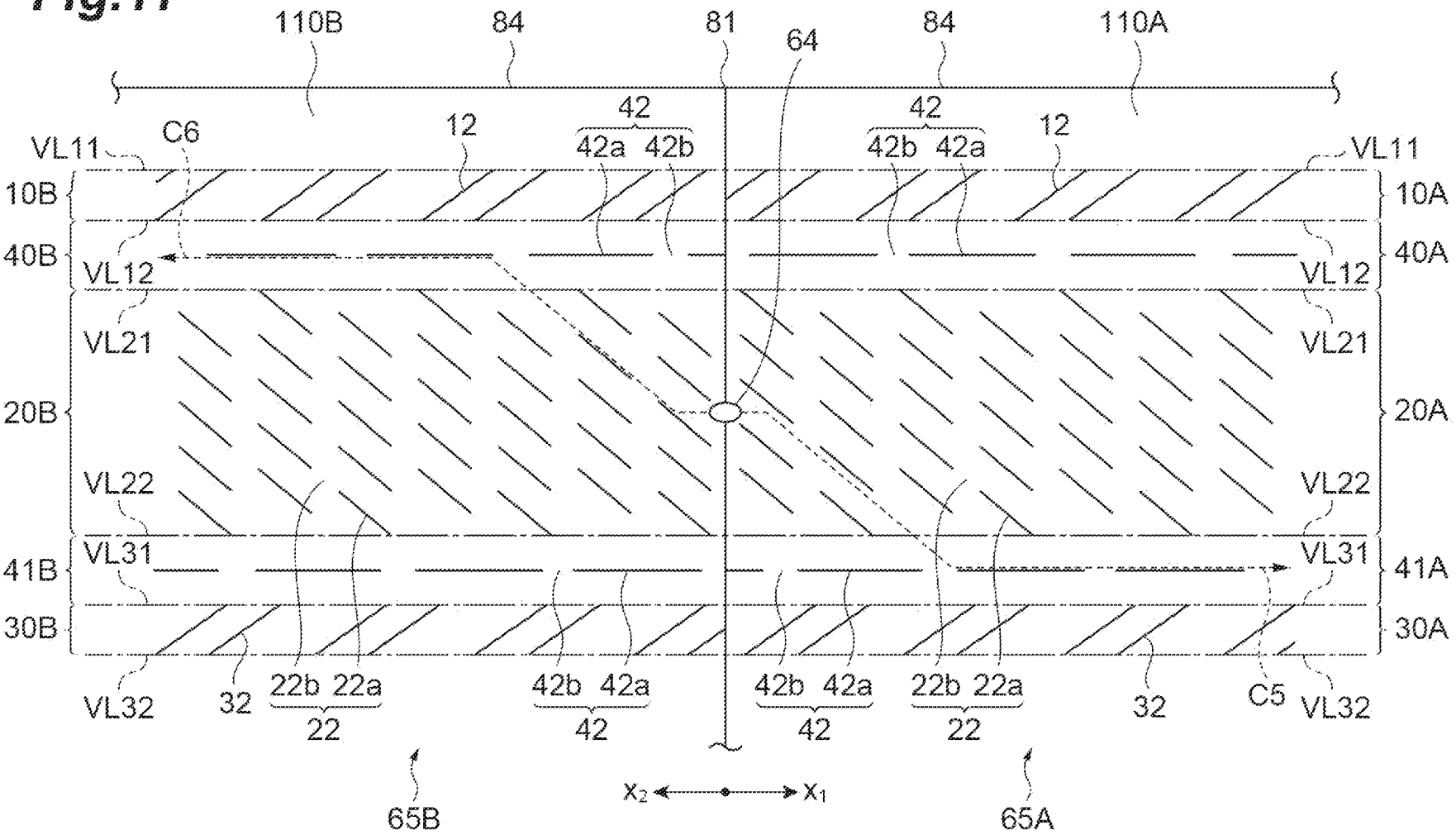
FIG. 11 is a view of the packaging bag and the packaging body when being unfolded by cutting the other side end portion according to another embodiment.

FIG. 10 is a plan view showing a front surface 110A side of a packaging bag 110 (packaging body 210) according to another embodiment. FIG. 11 is a view of the packaging bag 110 of FIG. 10 unfolded by cutting the other side end portion 82. In this embodiment, a cutting guide band 65A and a cutting guide band 65B for cut opening and unsealing the packaging bag 110 are provided in upper portions of a front surface 110A and a back surface 110B of the packaging bag 110, respectively, so as to cross between the one side end portion 81 and the other side end portion 82. As described above, the cutting guide band 65A and the cutting guide band 65B has structures different from those of the cutting guide band 60A and the cutting guide band 60B of the packaging bag 100 according to the foregoing embodiment. Configurations other than the cutting guide band 65A and the cutting guide band 65B of the packaging bag 110 may be the same as those of the packaging bag 100.

As shown in FIG. 10, the cutting guide band 65A (cutting guide band 65B) extends from the one side end portion 81 to the other side end portion 82. A notch 64 having a U shape for start of cut-opening is formed in the side end portion 81. The same notch is also formed in the other side end portion 82. The notch 64 may be included in the second guide bands 20A and 20B of the cutting guide bands 65A and 65B.

As shown in FIG. 11, the cutting guide band 65A includes the first guide band 10A, the fourth guide band 40A, the second guide band 20A, a fifth guide band 41A, and the third guide band 30A from the upper end portion 84 side. The first guide band 10A, the fourth guide band 40A, the second guide band 20A, and the third guide band 30A have the first cut lines 12, the fourth cut line 42, the second cut lines 22, and the third cut lines 32, respectively, that are same as those of the packaging bag 100. The fourth guide band 40A is a region between the first guide band 10A and the second guide band 20A, and is a band-shaped region defined by the imaginary line VL12 passing through the lower ends of the first cut lines 12 and extending parallel to the transverse direction (x direction), and by the imaginary line VL21 passing through the upper ends of the second cut lines 22 and extending parallel to the transverse direction (x direction). The fifth guide band 41A has the same fourth cut line 42 as that of the fourth guide band 40A. The fifth guide band 41A is a region between the second guide band 20A and the third guide band 30A, and is a band-shaped region defined by the imaginary line VL22 passing through the lower ends of the second cut lines 22 and extending parallel to the transverse direction (x direction), and by the imaginary line VL31 passing through the upper ends of the third cut lines 32 and extending parallel to the transverse direction (x direction).

Similarly to the cutting guide band 65A, the cutting guide band 65B includes the first guide band 10B, the fourth guide band 40B, the second guide band 20B, a fifth guide band 41B, and the third guide band 30B from the upper end portion 84 side. The first guide band 10B, the fourth guide band 40B, the second guide band 20B, and the third guide band 30B have the first cut lines 12, the fourth cut line 42, the second cut lines 22, and the third cut lines 32, respectively, that are same as those of the packaging bag 100. The fourth guide band 40B is a region between the first guide band 10B and the second guide band 20B, and is a band-shaped region defined by the imaginary line VL12 passing through the lower ends of the first cut lines 12 and extending parallel to the transverse direction (x direction), and by the imaginary line VL21 passing through the upper ends of the second cut lines 22 and extending parallel to the transverse direction (x direction). The fifth guide band 41B has the same fourth cut line 42 as that of the fourth guide band 40B. The fifth guide band 41B is a region between the second guide band 20B and the third guide band 30B, and is a band-shaped region defined by the imaginary line VL22 passing through the lower ends of the second cut lines 22 and extending parallel to the transverse direction (x direction), and by the imaginary line VL31 passing through the upper ends of the third cut lines 32 and extending parallel to the transverse direction (x direction).

In the packaging bag 110, as shown in FIG. 11, with regard to a positional relationship, the first guide band, the second guide band, the third guide band, the fourth guide band, and the fifth guide band are line-symmetric with respect to the side end portion 81 as an axis. Namely, the first guide band, the second guide band, the third guide band, the fourth guide band, and the fifth guide band are arranged in the same order on the front surface 110A and on the back surface 110B.

As shown in FIG. 11, when cut-opening is started from the notch 64, first, a tip of the cut-opening progresses along the transverse direction ($x_1$ and $x_2$ directions), and then reaches the second cut line 22. Thereafter, on the front surface 110A, the tip of the cut-opening is guided by the second cut line 22 to bend downward and then to reach the fourth cut line 42 of the fifth guide band 41A. Thereafter, the tip of the cut-opening progresses on the fourth cut line 42 to form a cutting line C5. On the other hand, on the back surface 110B, the tip of the cut-opening bends upward to reach the fourth cut line 42 of the fourth guide band 40B. Thereafter, the tip of the cut-opening progresses on the fourth cut line 42 to form a cutting line C6. Since the cutting line C5 and the cutting line C6 are not line symmetric with respect to an outer edge of the side end portion 81 as an axis, a grip portion can be formed.

When cut-opening is started from a notch 66 of the other side end portion 82 shown in FIG. 10, on the front surface 110A, a tip of the cut-opening is guided by the second cut line 22 to bend upward and then to reach the fourth cut line 42 of the fourth guide band 40A. Thereafter, the tip of the cut-opening progresses on the fourth cut line 42 to form a cutting line. On the other hand, on the back surface 110B, the tip of the cut-opening is guided by the second cut line 22 to bend downward and then to reach the fourth cut line 42 of the fifth guide band 41B. Thereafter, the tip of the cut-opening progresses on the fourth cut line 42 to form a cutting line. Since the two cutting lines formed in such a manner are not line-symmetric with respect to the side end portion 81 as an axis, a grip portion can be formed.

In the packaging bag 110, even when cutting is started from one of a pair of the side end portions, cut-opening can be guided to the fourth cut line 42 on both the front surface 100A and the back surface 100B. Therefore, it is possible to sufficiently prevent the cut-opening from deviating from the cutting guide bands 65A and 65B, and progressing in an unexpected direction during unsealing.

A tear strength when the laminated film portions 91 and 92 forming the packaging bags 100 and 110 are torn along the cutting guide bands 60A and 60B (65A and 65B) is preferably 0.1 to 2.0 N, more preferably 0.2 to 0.9 N. The packaging bag 100 (110) and the packaging body 200 (210) configured by pasting together the laminated film portions 91 and 92 including the cutting guide bands 60A and 60B (65A and 65B) having such tear strength can be gripped and smoothly unsealed by the fingers.

Figure 12:
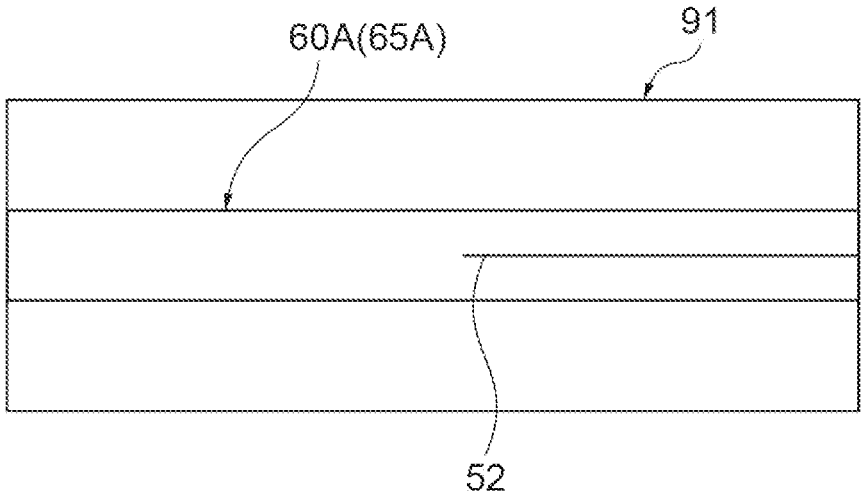
FIG. 12 is a view for describing a method for measuring a tear strength.
Figure 13:
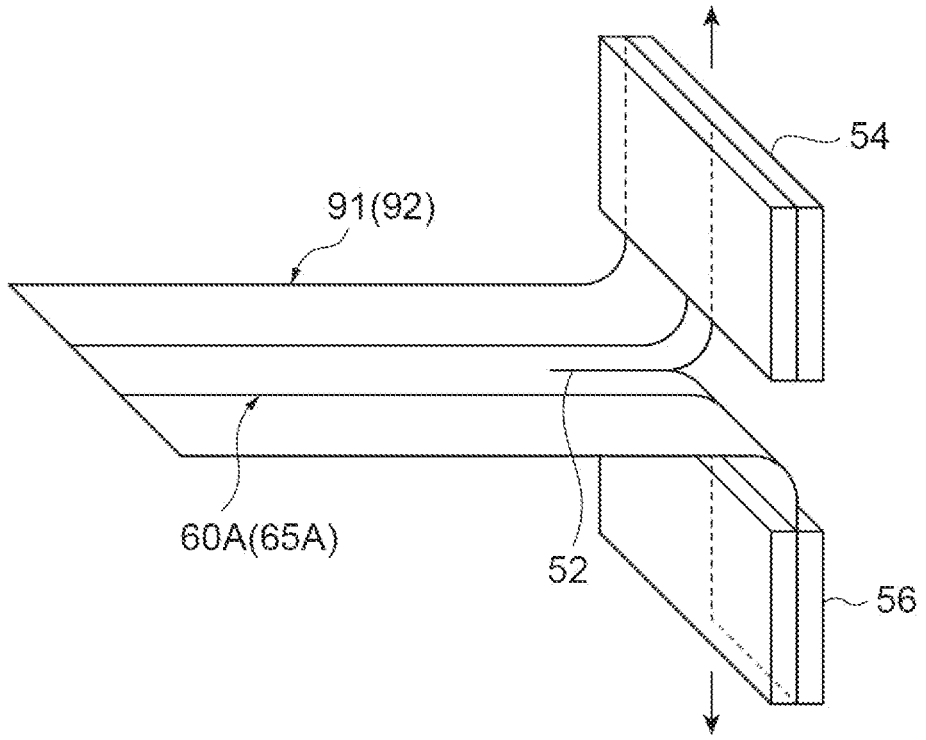
FIG. 13 is a view for describing the method for measuring a tear strength.

The tear strength of the present disclosure is measured in accordance with JIS K 7128-1:1998. FIGS. 12 and 13 are views for describing a method for measuring a tear strength. The laminated film portion 91 (laminated film 91) in which the cutting guide band 60A (65A) is formed is processed into a rectangular test piece (length×width=50 mm×150 mm) shown in FIG. 12. A cut 52 (length: 75 mm) is made from one end from a central portion of a short side of the cutting guide band 60A (65A) formed to cross the test piece. The cut 52 is formed to pass through a central portion of the cutting guide band 60A (65A). As shown in FIG. 13, the cutting guide band 60A (65A) is torn by pinching and pulling two end portions that are cut open by the cut 52, in the up-down direction at a test speed of 200 mm/min with a jig 54 and a jig 56, respectively. The strength is measured from the beginning of tearing of the test piece to the completion of tearing. A maximum value of a measured value is the tear strength of the present disclosure. A tear strength of the laminated film portion 92 (laminated film 92) can also be measured in the same manner.

Figure 14:
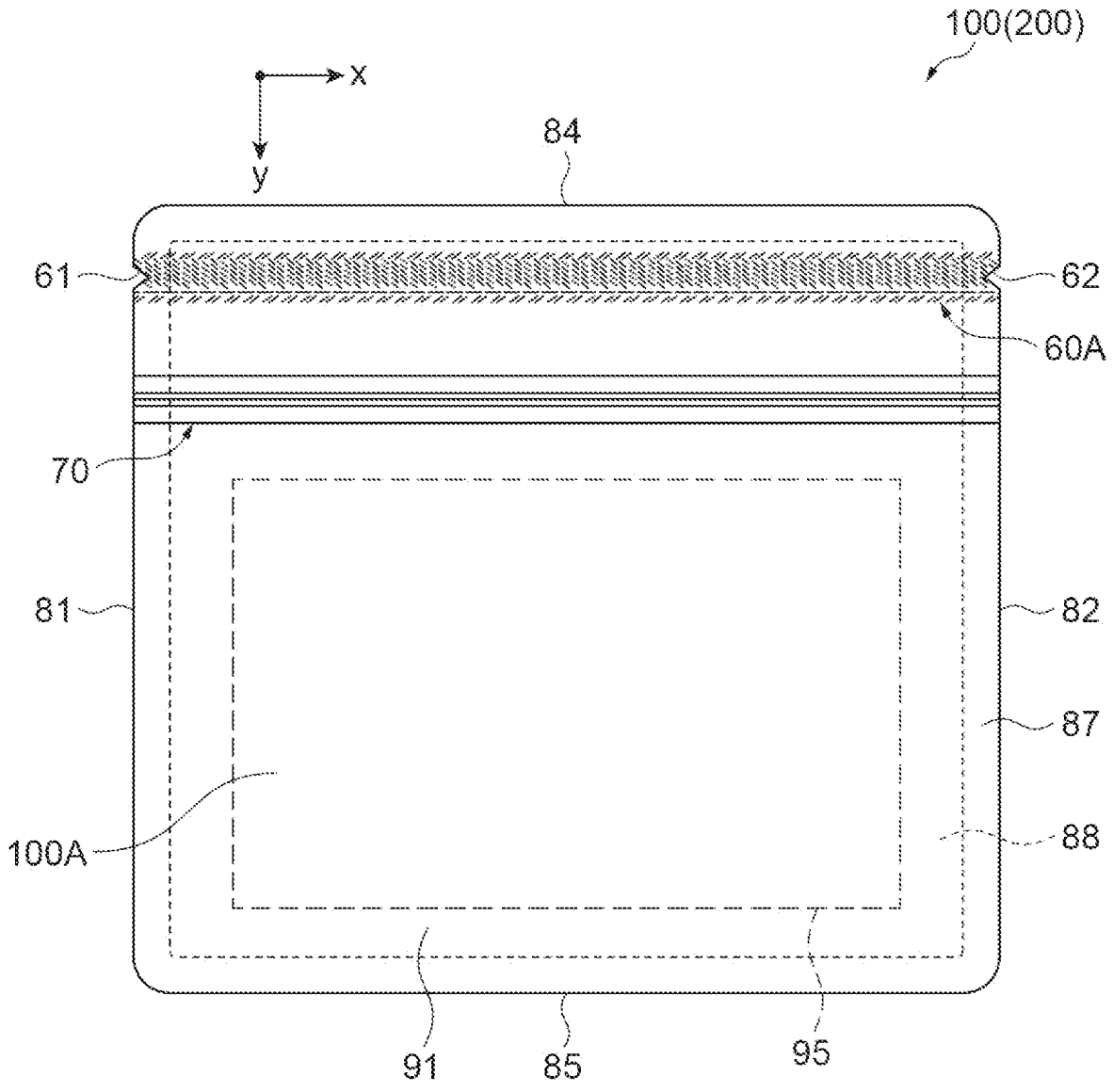
FIG. 14 is a plan view showing the packaging body according to one embodiment and a patch contained in the packaging body.

In FIG. 14, a patch 95 contained in the containing portion 88 formed between a pair of the laminated film portions 91 and 92 of the packaging bag 100 (packaging body 200) shown in FIGS. 1 and 2 is indicated by a dotted line. In such a manner, the packaging body 200 (210) shown in FIGS. 1, 2, 10, and the like includes the packaging bag 100 (110) and the patch contained in the containing portion of the packaging bag 100 (110). In the packaging bag 100 (110), it is possible to sufficiently prevent cut-opening from deviating from the cutting guide bands 60A and 60B (65A and 65B), and progressing in an unexpected direction during unsealing, and it is possible to stably form the grip portion 75. Therefore, the patch can be smoothly taken out from the packaging body 200 (210). In addition, since the packaging bag 100 (110) of the packaging body 200 (210) includes the sealing portion 70, it is possible to maintain the effectiveness of the patch at a high level for a long period of time by sealing the sealing portion 70 even after the packaging bag 100 (110) is unsealed once.

The packaging bag 100 (110) and the packaging body 200 (210) of the present disclosure can be manufactured, for example, in the following procedure. First, each of the laminated films 91 and 92 is obtained by pasting the polyethylene resin layer 76, the barrier layer 74, and the sealant layer 72 to paper or a resin film serving as the base material layer 78, using a known method. The cutting guide bands 60A and 60B are formed by pushing a metal blade against front surfaces of the base material layers 78 of the obtained laminated films 91 and 92. Exemplary examples of the metal blade include a rotary blade, a push blade, and the like. Instead of the metal blade, the cutting guide bands 60A and 60B may be formed using a laser beam.

The sealed portion 87 is formed at positions corresponding to the upper end portion 84 and to the side end portions 81 and 82 by setting the sealant layers 72 of the laminated films 91 and 92 in which the cutting guide bands 60A and 60B are formed, to face each other, and by bonding the sealant layers 72 to each other in a state where, for example, a fastener tape serving as the sealing portion 70 is sandwiched therebetween. Accordingly, a non-sealed portion surrounded by the sealed portion 87 having a U shape is formed. The laminated films 91 and 92 are divided into individual bags by cutting and trimming the sealed portion 87. In such a manner, the packaging bags are obtained. The packaging bag of the present disclosure includes a bag in which a packaging article is not yet contained in such a manner and in which a part of an outer edge is not sealed.

Thereafter, the notches 61 and 62 (notches 64 and 66) are formed in the cutting guide bands 60A and 60B at the side end portions 81 and 82, respectively. The packaging article is inserted through the lower end portion 85 that is in a non-sealed state. Thereafter, the sealed portion 87 is formed at the lower end portion 85 by bonding the laminated films 91 and 92 to each other at the lower end portion 85. In such a manner, the packaging body 200 (210) in which the packaging article is contained in the containing portion of the packaging bag 100 (110) can be manufactured. However, the method for manufacturing the packaging bag and the packaging body is not limited to such a method.

Several embodiments of the present disclosure have been described above. In the packaging bag 100 (110) provided as an example, the laminated film 91 on the front surface side and the laminated film 92 on the back surface side are pasted together, and the cutting guide bands 60A and 60B (65A and 65B) extending in a band shape along the transverse direction (x direction) from the one side end portion 81 toward the other side end portion 82 are provided on the front surface and on the back surface, respectively. The cutting guide bands 60A and 60B (65A and 65B) include, in order from the upper end portion side, the first guide bands 10A and 10B each having the plurality of first cut lines 12 that are inclined at a predetermined angle with respect to the transverse direction (x direction), and that are arranged parallel to each other; the second guide bands 20A and 20B each having the plurality of second cut lines 22 that are perforated, that are inclined at a predetermined angle in a direction opposite that of the first cut lines 12 with respect to the transverse direction, and that are arranged parallel to each other at predetermined intervals; and the third guide bands 30A and 30B each having the plurality of third cut lines 32 that are inclined at a predetermined angle in the same direction as that of the first cut lines 12 with respect to the transverse direction (x direction), and that are arranged parallel to each other, respectively. The packaging bag 100 (110) has the fourth cut line 42 between the first guide bands 10A and 10B and the second guide bands 20A and 20B and/or between the second guide bands 20A and 20B and the third guide bands 30A and 30B, the fourth cut line 42 being perforated and extending along the transverse direction. The first cut lines 12, the second cut lines 22, the third cut lines 32, and the fourth cut line 42 are spaced apart from each other. The first cut lines 12, the second cut lines 22, and the third cut lines 32 are inclined in opposite directions with respect to the transverse direction (x direction) on the front surface and on the back surface.

The present disclosure is not limited to the foregoing embodiments by any means. For example, the laminated film (laminated film portion) may include any layer or thin film between the layers without significantly impairing the function of the laminated film. In terms of shape, the packaging bag is not limited to a four-sided bag. For example, the packaging bag may be a two-sided bag, a three-sided bag, or a butt-seamed bag. The packaging bag may not include the sealing portion and the notches. The notches are not limited to having a V shape and a U shape, and may have, for example, an I shape or may be a group of scars.

EXAMPLES

Hereinafter, contents of the present disclosure will be described in more detail with reference to examples, but the present disclosure is not limited to the following examples.

Example 1

Cut lines were provided by pushing metal rotary blades against a front surface of a biaxially oriented polyethylene terephthalate film (PET film and thickness: 16 μm), so that the cutting guide band 60A shown in FIG. 3 was formed. Thereafter, an anchor coating agent was applied to the above-described PET film by extrusion lamination, and a biaxially oriented polyethylene film having a thickness of 20 μm and an aluminum foil having a thickness of 7 μm and serving as a barrier layer were pasted together. Then, the anchor coating agent was applied to the aluminum foil, and a polyethylene film having a thickness of 25 μm and serving as a sealant layer was pasted thereto. In such a manner, a laminated film having the lamination structure shown in FIG. 9 was obtained. The sizes of each guide band and each cut line were roughly as follows.

Width of the cutting guide band 60A: 7.2 mm
Width of the first guide band 10A: 0.9 mm
Width of the second guide band 20A: 4.2 mm
Width of the third guide band 30A: 0.9 mm
Width of the fourth guide band 40A: 1.2 mm <First Cut Line 12>

L1=1.5 mm, D1=0.9 mm, S1=2.2 mm, and θ1=35 degrees

<Second Cut Line 22>

L2=1.2 mm, D2=0.6 mm, S2=1.4 mm, and θ2=40 degrees

<Third Cut Line 32>

L3=1.5 mm, D3=0.9 mm, S3=2.2 mm, and θ3=35 degrees

<Fourth Cut Line 42>

L4=2.2 mm, D4=0.6 mm

The laminated film was processed into a rectangular test piece (length×width=50 mm×150 mm) shown in FIG. 12, and then as shown in FIG. 13, a tear strength was measured in accordance with JIS K 7128-1:1998. A measured value was 0.35 to 0.5 N, and a maximum value (tear strength) was 0.5 N.

INDUSTRIAL APPLICABILITY

According to the present disclosure, it is possible to provide the packaging bag and the packaging body which can be smoothly unsealed and from which a packaging article can be easily taken out. In addition, it is possible to provide the packaging bag and the packaging body capable of sufficiently preventing cut-opening from deviating from the cutting guide bands, and progressing in an unexpected direction during unsealing.

REFERENCE SIGNS LIST

C1, C2, C3, C4, C5, C6: cutting line, D1, D2, D3, S1, S2, S3: interval, θ1, θ2, θ3: angle, 10A, 10B: first guide band, 12: first cut line, 20A, 20B: second guide band, 22: second cut line, 22*a*, 42*a*: line portion, 22*b*, 42*b*: non-line portion, 30A, 30B: third guide band, 32: third cut line, 40A, 40B: fourth guide band, 41A, 41B: fifth guide band, 42: fourth cut line, 54, 56: jig, 60A, 60B, 65A, 65B: cutting guide band, 61, 62, 64, 66: notch, 70: sealing portion, 72: sealant layer, 74: barrier layer, 75: grip portion, 76: polyethylene resin layer, 78: base material layer, 81, 82: side end portion, 84: upper end portion, 85: lower end portion, 87: sealed portion, 88: containing portion, 91, 92: laminated film portion (laminated film), 95: patch, 100, 110: packaging bag, 100A, 110A: front surface, 100B, 110B: back surface, 200, 210: packaging body, VL11, VL12, VL21, VL22, VL31, VL32: imaginary line.

The invention claimed is:

1. A packaging bag comprising:

a first laminated film portion on a front surface side;

a second laminated film portion on a back surface side, that is pasted to the first laminated film portion; and a cutting guide band extending in a band shape along a transverse direction from one side end portion toward an other side end portion on each of a front surface and a back surface, wherein the cutting guide band includes, in order from an upper end portion side, a first guide band having a plurality of first cut lines that are inclined at an angle with respect to the transverse direction, and that are arranged parallel to each other;

a second guide band having a plurality of second cut lines that are perforated, that are inclined at an angle in a direction opposite a direction of the first cut lines with respect to the transverse direction, and that are arranged parallel to each other at intervals; and a third guide band having a plurality of third cut lines that are inclined at an angle in a same direction as the direction of the first cut lines with respect to the transverse direction, and that are arranged parallel to each other, the cutting guide band has a fourth cut line between the first guide band and the second guide band and/or between the second guide band and the third guide band, the fourth cut line being perforated and extending along the transverse direction, the first cut lines, the second cut lines, the third cut lines, and the fourth cut line are spaced apart from each other, the first cut lines, the second cut lines, and the third cut lines on the front surface are inclined in directions opposite directions of the first cut lines, the second cut lines, and the third cut lines on the back surface with respect to the transverse direction, respectively, and a disposition of the fourth cut line is different between the front surface and the back surface, so that the front surface has the fourth cut line between the second guide band and the third guide band, and when viewed along the transverse direction, both the second cut lines and the third cut lines are inclined toward the fourth cut line, and the back surface has the fourth cut line between the first guide band and the second guide band, and when viewed along the transverse direction, both the first cut lines and the second cut lines are inclined toward the fourth cut line.

2. The packaging bag according to claim 1, wherein on the front surface, an imaginary line being parallel to the transverse direction and passing through lower ends of the plurality of first cut lines intersects at least some of the second cut lines that are perforated, and on the back surface, an imaginary line being parallel to the transverse direction and passing through upper ends of the plurality of third cut lines intersects at least some of the second cut lines that are perforated.

3. The packaging bag according to claim 1, wherein the second cut lines of the front surface and the second cut lines of the back surface are disposed offset from each other in an up-down direction.

4. The packaging bag according to claim 1, wherein a width of the cutting guide band is 4 mm or more.

5. The packaging bag according to claim 1, wherein the cutting guide band extends from the one side end portion to the other side end portion, and the second guide band includes notches at the side end portions.

6. The packaging bag according to claim 1, further comprising:

a containing portion that contains a packaging article; and a sealing portion that is provided between the containing portion and the cutting guide band, and that is configured to seal the containing portion along the cutting guide band after unsealing.

7. The packaging bag according to claim 1, wherein each of the first laminated film portion and the second laminated film portion has a lamination structure in which a sealant layer, a barrier layer containing an inorganic substance, a polyethylene resin layer, and a base material layer are laminated in order from an inside.

8. The packaging bag according to claim 1, wherein a tear strength of each of the first laminated film portion and the second laminated film portion when being torn along the cutting guide band is 0.1 to 2.0 N.

9. A packaging body comprising:

the packaging bag according to claim 1; and a patch contained in a containing portion of the packaging bag.

10. The packaging bag according to claim 1, wherein the fourth cut line on the front surface and the fourth cut line on the back surface are provided not to overlap each other.

* * * * *